US008348059B2

(12) United States Patent
Rice

(10) Patent No.: US 8,348,059 B2
(45) Date of Patent: Jan. 8, 2013

(54) DISPLAY PACKAGING FOR RECONFIGURABLE PRODUCT

(75) Inventor: Brian M. Rice, Tonawanda, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/762,476

(22) Filed: Apr. 19, 2010

(65) Prior Publication Data

US 2010/0203795 A1 Aug. 12, 2010

Related U.S. Application Data

(62) Division of application No. 11/466,228, filed on Aug. 22, 2006, now Pat. No. 7,726,482.

(60) Provisional application No. 60/709,817, filed on Aug. 22, 2005.

(51) Int. Cl.
*B65D 73/00* (2006.01)

(52) U.S. Cl. ..... 206/461; 206/775; 206/776; 206/767; 206/736; 446/72; 446/73; 446/75

(58) Field of Classification Search ..... 206/461, 206/775, 776, 767, 736; 446/73, 72, 75, 446/77

See application file for complete search history.

(56) References Cited

U.S. PATENT DOCUMENTS

| | | | | |
|---|---|---|---|---|
| 153,094 | A | | 7/1874 | Libby |
| 247,302 | A | | 9/1881 | Candy |
| 250,026 | A | | 11/1881 | Whitelaw |
| 261,775 | A | | 7/1882 | Smith |
| 478,536 | A | | 7/1892 | Dunham |
| 639,679 | A | | 12/1899 | Kaufmann |
| 1,064,576 | A | | 6/1913 | Washburn |
| 2,571,744 | A | | 10/1951 | Midouhas |
| 2,697,301 | A | * | 12/1954 | Glass et al. ..... 446/73 |
| 2,844,898 | A | * | 7/1958 | Youngren ..... 446/151 |
| 2,926,487 | A | * | 3/1960 | Stone ..... 368/1 |
| 2,931,657 | A | | 4/1960 | Lewis |
| 2,935,814 | A | | 5/1960 | Freeze |
| 2,979,841 | A | | 4/1961 | Bellis |
| 3,492,756 | A | | 2/1970 | Stubbmann |
| 3,717,942 | A | | 2/1973 | Presby |
| 3,864,870 | A | * | 2/1975 | Breslow et al. ..... 446/334 |
| 3,974,593 | A | * | 8/1976 | Walker, Jr. ..... 446/73 |
| 4,165,805 | A | * | 8/1979 | Fethke et al. ..... 206/349 |
| 4,373,729 | A | | 2/1983 | Hanson |
| 4,407,083 | A | * | 10/1983 | Hartgrave ..... 40/414 |
| 4,412,399 | A | * | 11/1983 | Abe et al. ..... 446/359 |

(Continued)

*Primary Examiner* — J. Gregory Pickett
*Assistant Examiner* — Blaine Neway
(74) *Attorney, Agent, or Firm* — Edell, Shapiro & Finnan, LLC

(57) ABSTRACT

The present invention is directed generally to container for reconfigurable products and, in particular, to a display package operable to display a product in multiple configurations. The display package may include product housing portions adapted to slide from a first, adjacent position, where one product portion is positioned adjacent to another product portion, to a second, separated position, where one product portion is spaced from the other product portion. The display package may include a plurality of product housings adapted to rotate with respect to each other along a common axis such that product portions within the product housings may be selectively aligned to form desired configurations of a completed, displayed product. The display package may include a stationary housing section and a movable housing section adapted to rotate with respect to the stationary housing section such that the product portions within the movable housing section may be selectively aligned with the product portions of the stationary housing section.

19 Claims, 19 Drawing Sheets

U.S. PATENT DOCUMENTS 5,712,004 A 1/1998 Lin
5,718,335 A 2/1998 Boudreaux
5,809,674 A 9/1998 Key
5,896,991 A * 4/1999 Hippely et al. ..... 206/461
6,146,721 A 11/2000 Freynet
6,220,439 B1 4/2001 Virvo
6,311,839 B1 * 11/2001 Lo ..... 206/371
6,682,392 B2 1/2004 Chan
6,726,019 B2 4/2004 Leung
2008/0029418 A1 * 2/2008 Calendrille, Jr. ..... 206/462

* cited by examiner

DISPLAY PACKAGING FOR RECONFIGURABLE PRODUCT

CROSS-REFERENCE TO RELATED APPLICATIONS

This application is a divisional of U.S. patent application Ser. No. 11/466,228, filed 22 Aug. 2006 and entitled "Display Packaging for Reconfigurable Product," which is a nonprovisional of U.S. Provisional Patent Application No. 60/709,817, filed 22 Aug. 2005 and entitled "Display Packaging for Reconfigurable Product Portions." The disclosures of aforementioned applications are incorporated herein by reference in their entireties.

BACKGROUND OF THE INVENTION

The present invention relates to a container for a reconfigurable product such as toy and, more particularly, to a display package for a product comprising a plurality of product portions, each portion representing a part of a complete product, wherein the product portions may be selectively aligned to form desired configurations of a completed, displayed product.

SUMMARY OF THE INVENTION

The present invention is directed generally to container for reconfigurable products and, in particular, to a display package operable to display a product in multiple configurations. In one embodiment, the display package may include product housing portions adapted to slide from a first, adjacent position, where one product portion is positioned adjacent to another product portion, to a second, separated position, where one product portion is spaced from the other product portion. In another embodiment, the display package may include a plurality of product housings adapted to rotate with respect to each other along a common axis such that product portions within the product housings may be selectively aligned to form desired configurations of a completed, displayed product. In still another embodiment, the display package may include a stationary housing section and a movable housing section adapted to rotate with respect to the stationary housing section such that the product portions within the movable housing section may be selectively aligned with the product portions of the stationary housing section.

BRIEF DESCRIPTION OF THE DRAWINGS

FIG. 6 illustrates a close-up view of the segmented portion housings of the reconfigurable display package, showing a complete product (made up of two product portions) displayed in a first configuration.

FIG. 7 illustrates a front view of the display package, showing partial rotation of one of the segmented portion housings with respect to the other segmented portion housing.

FIG. 8 illustrates a close-up view of the segmented portion housings, showing a complete second product (made up of two product portions) displayed in a second configuration.

Like reference numerals have been used to identify like elements throughout this disclosure.

DETAILED DESCRIPTION OF THE INVENTION

In accordance with the present invention, a container or package for displaying a product (e.g., a toy) comprising multiple, interchangeable product portions is disclosed. The display package permits an individual to manipulate or reconfigure the package to alter the appearance of a complete product contained therein. The reconfigurable display package may comprise a base, a frame, and a product housing. In one embodiment, the reconfigurable display package of the present invention may include interchangeable cards, as well as product housing portions adapted to slide from a first, adjacent position (where one product portion is positioned adjacent to another product portion) to a second, separated position (where one product portion is spaced from the other product portion). In another embodiment, the product housing may include adjacent housing segments, each including a set of complementary product portions (where multiple product portions (at least two) are placed in an adjacent relationship to form a complete product). Furthermore, at least one housing segment may be operable to rotate with respect to another housing segment. With this configuration, a user (or buyer at the point of sale) may selectively align and re-align the housing segments, and thus, the product portions to display a variety of complete products. The reconfiguration ability allows a user (or buyer at the point of sale) to create multiple different completed products by simply reorienting the housing segments of the display package.

Figure 1:
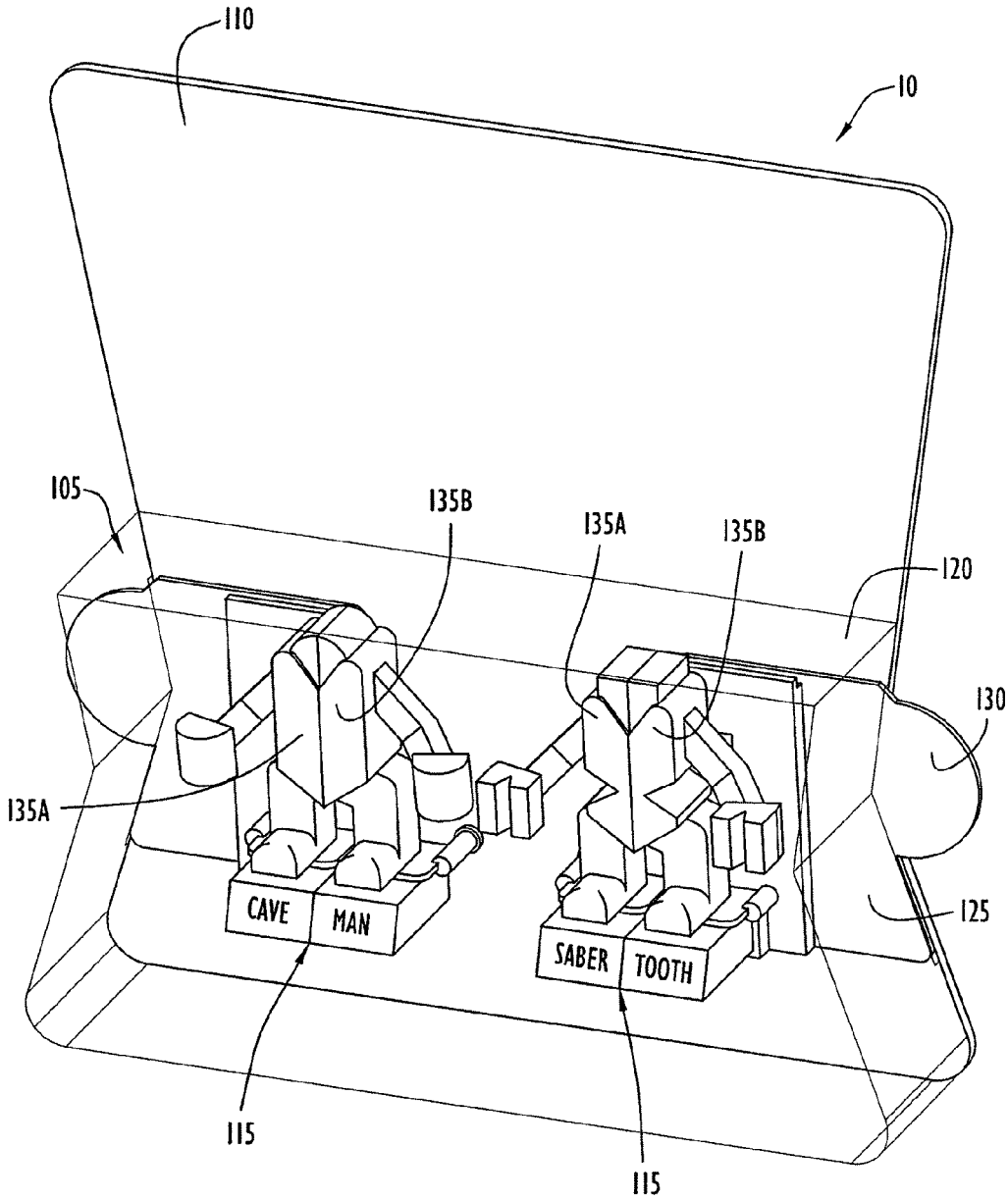
FIG. 1 illustrates a front perspective view of a reconfigurable display package according to an embodiment of the present invention.

FIG. 1 is a front perspective view of a reconfigurable display package 10 in accordance with an embodiment of the present invention. As illustrated, the display package 10 may include a housing 105 coupled to a backing member 110. The display package 10 may be formed from materials including but not limited to, transparent or opaque materials such as cardboard, e-flute, paper, plastic, wood, etc. In addition, portions of the housing 105 and/or backing 110 may be selectively formed from translucent or opaque materials. In the embodiment of FIG. 1, the housing 105 includes transparent shell 120 with at least one sliding member 125 that translates with respect to the backing 110. The sliding member 125, in turn, may include an actuator 130 which extends through the shell 120 to enable the selective movement of the sliding member 125 (described in greater detail below).

The reconfigurable display package 100 of the present invention is capable of displaying a complete product 115 such that portions of the complete product may be reoriented from a first display configuration to a second display configuration while stored within the housing 105. A complete product 115, housed within the shell 120, may include a plurality of portions, each of which may be repositioned with respect to the other. For example, the complete product 115 may include a first product portion 135A and a second product portion 135B, which, together, form the complete product 115. When the complete product 115 is a toy figure, the first product portion 135A may form the left half of the figure (i.e., one half of a humanoid form including the left half of the head, the left half of the torso, the left arm, and the left leg) and the second product portion 135B may form the right half of the figure (i.e., one half of a humanoid form including the right half of the head, the right half of the torso, the right arm, and the right leg). Examples of product portions 135A, 135B that may be used with the display package of the present invention are described in U.S. Pat. No. 7,291,052 ("Ellman et al."), the disclosure of which is hereby incorporated by reference in its entirety.

Figure 2:
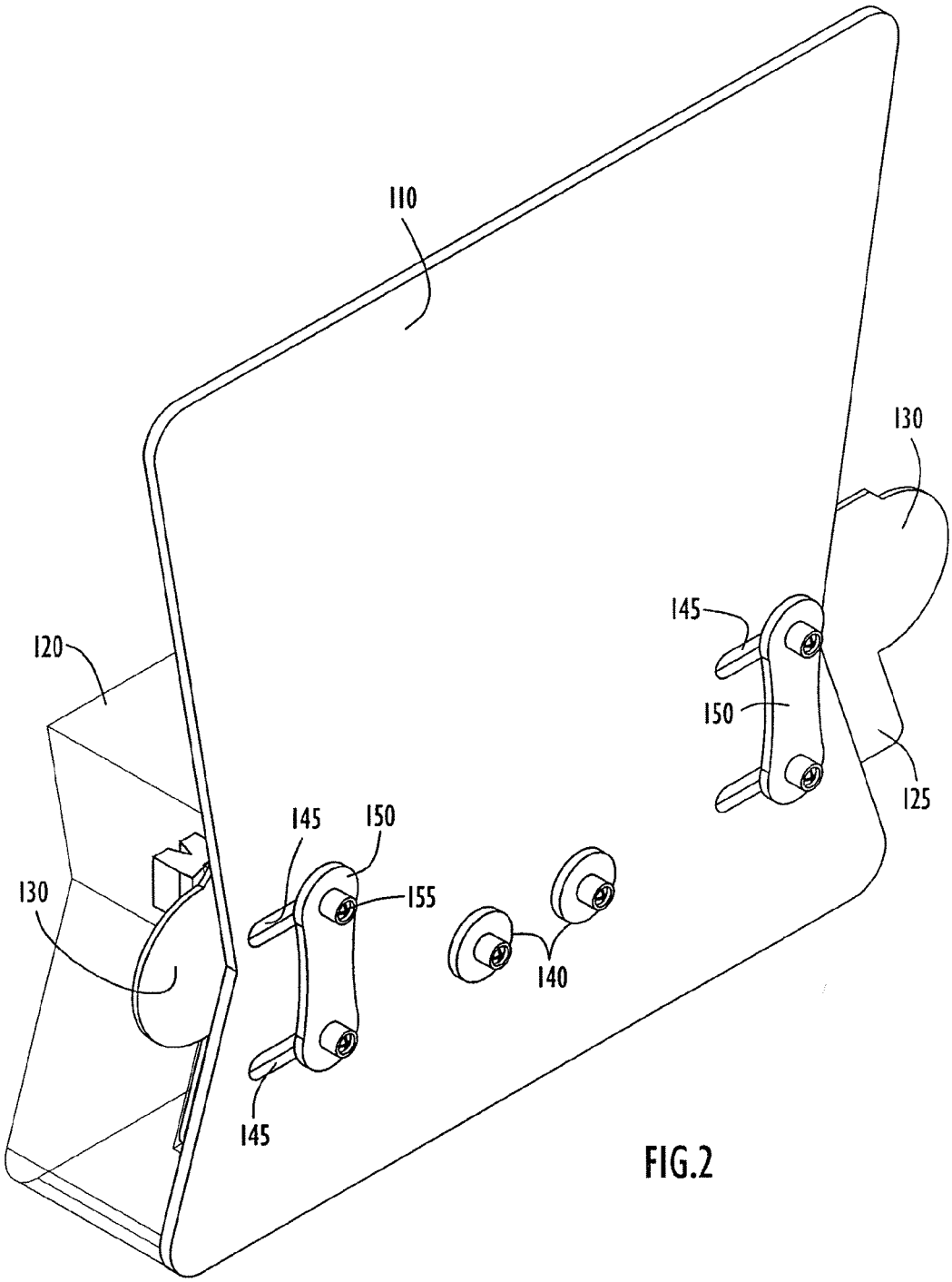
FIG. 2 illustrates a rear perspective view of the display package of FIG. 1.

The display package 10 is capable of reorienting the first and second product portions 135A, 135B from a first display position, wherein the first product portion 135A is coupled to and/or in contact with the second product portion 135B, to a second display position, wherein the first product portion 135A is separated from the second product portion 135B. Specifically, the first product portion 135A may be attached to the backing member 110, while the second product portion 135B may be attached to the sliding member 125 (as shown on the left side of FIG. 1). Alternatively, the second product portion 135B may be attached to the backing member 110, while the first product portion 135A may be attached to the sliding member 125 (as shown on the right side of FIG. 1). FIG. 2 is a rear perspective view of the display package of FIG. 1. As shown, the backing member 110 may include bosses 140 extending into the shell 120 that are operable to fix the first or second product portions 135A, 135B to the backing member 110 (as explained below). The backing member 110 may further include one or more guide channels 145 along which a tab 150 slides. Specifically, the tab 150 may include a post or rib 155 extending into the shell 120 that attaches the sliding member 125 to the backing member 110. The ribs 155 ride along the guide channels 145. With this configuration, engaging the actuator 130 causes the movement of the sliding member 125 along the guide channels 145.

Figure 3A:
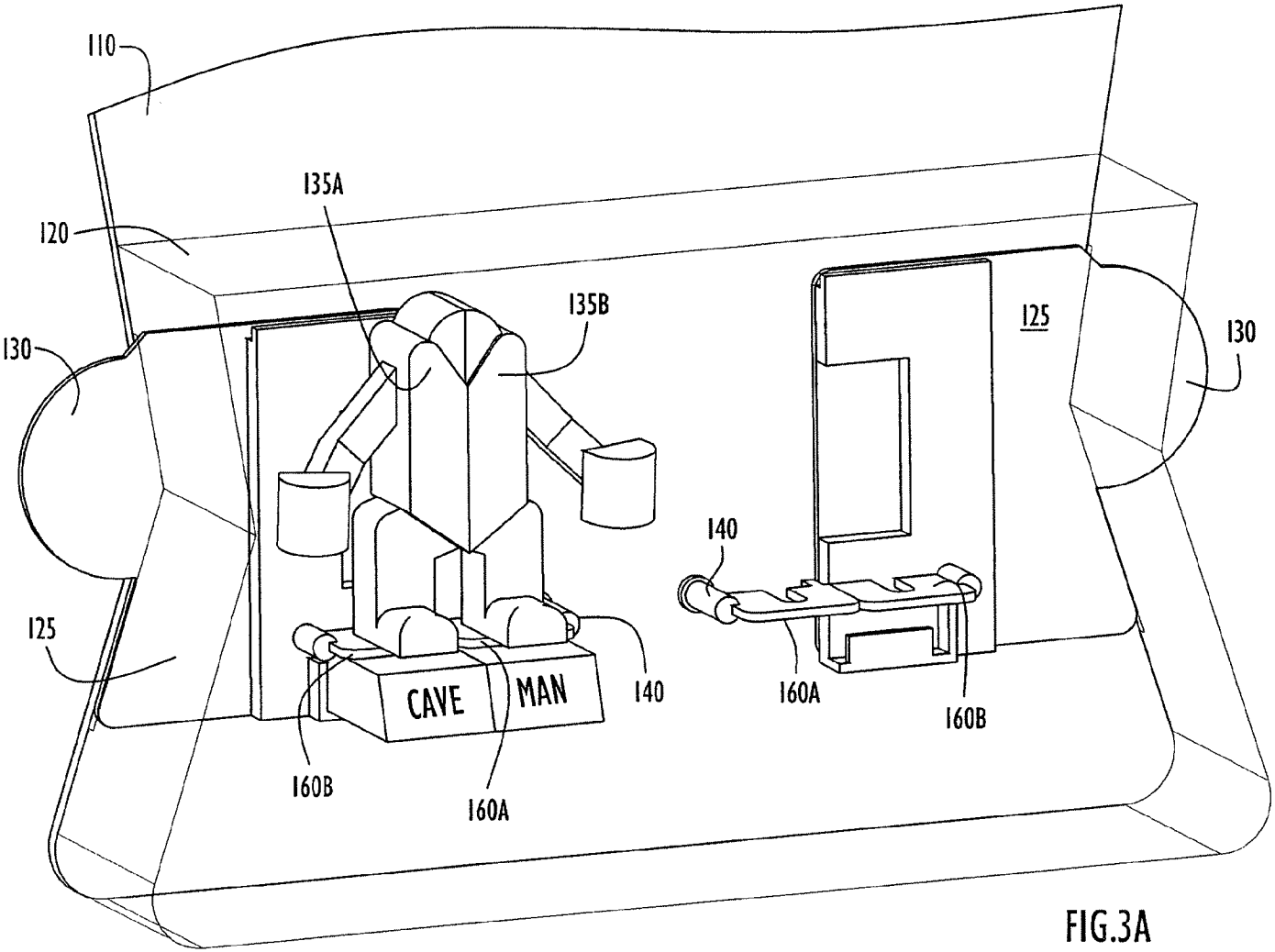
FIGS. 3A and 3B illustrate close-up views of the lower section of the reconfigurable display package of FIG. 1, showing movement of product portions from a first display position, in which one product portion is positioned adjacent to another product portion, to a second display position, where one product portion is spaced from the other product portion.
Figure 3B:
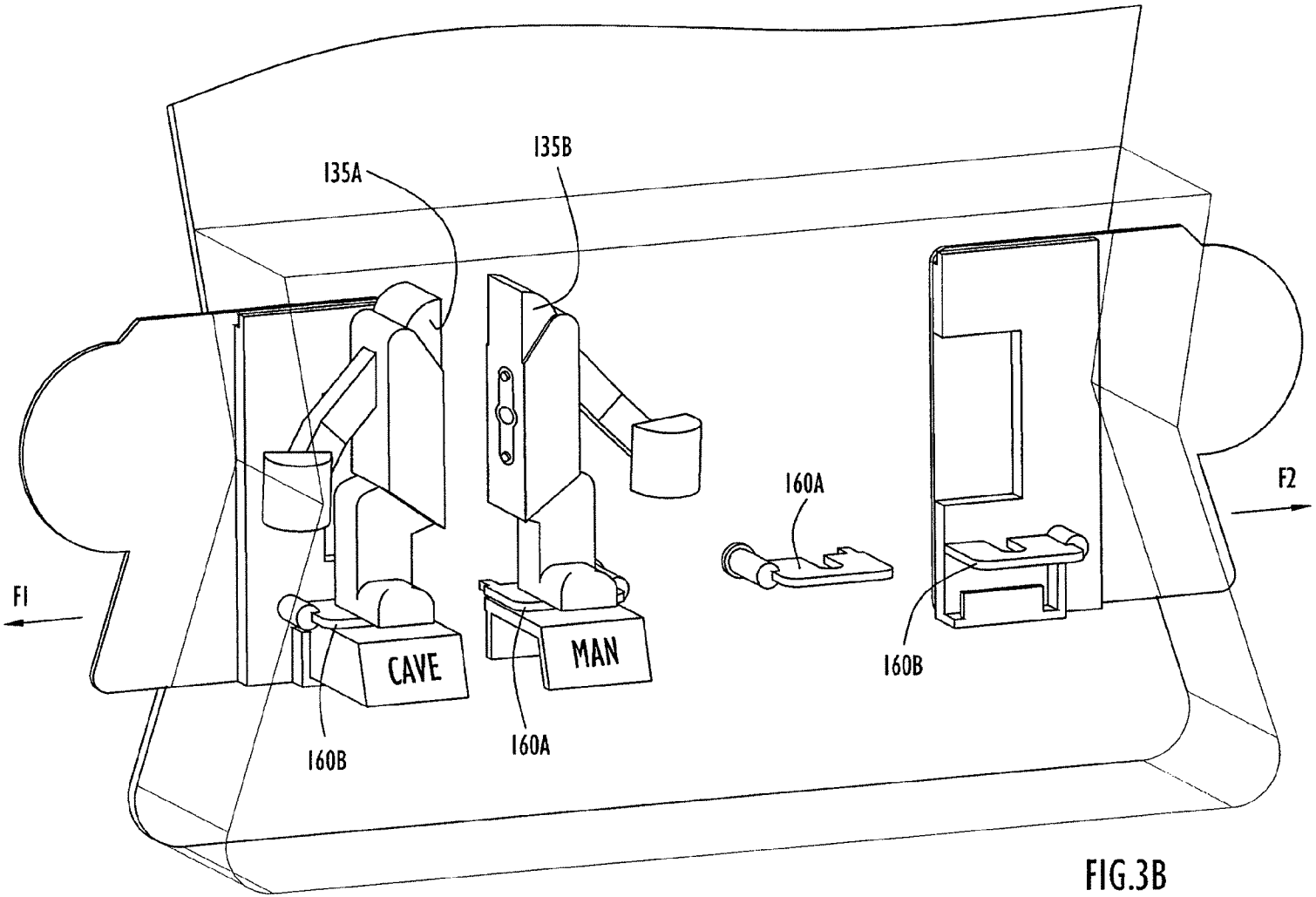

Operation of the display package 10 is explained with reference to FIGS. 3A and 3B, which are close-up views of the housing 105, with the right-hand complete FIG. 115 removed for clarity. The fixed boss 140 extends into the shell 120, coupling a first or fixed platform 160A the backing member 110. The fixed platform 160A may be configured to support a product portion 135A, 135B (i.e., the right figure side or left figure side) thereon. Similarly, a second or moveable platform 160B supports a product portion 135A, 135B complementary to that supported by the fixed platform 160A. The moveable platform 160B may be coupled to the sliding member 125 such that movement of the sliding member causes a corresponding movement to the moveable platform 160B. Thus, this configuration enables the sliding member 125 (and thus its associated product portion 135A or 135B) to begin in a first display position, in which the complementary portions (the first and second product portions 135A, 135B) are adjacent to (e.g., in contact with) each other (as illustrated in FIGS. 1 and 3A). Then, when a force is applied to the actuator 130 (indicated by arrows F1 and F2 in FIG. 3B), the moveable platform 160B moves horizontally away from the fixed platform 160B, repositioning the sliding members 125 (and thus the complementary product portions 135A, 135B) to a second display position, in which the complementary product portions 135A, 135B are in spaced relationship with respect to each other (FIG. 3B). An opposite force returns the product portions 135A, 135B to the first display position.

Although not illustrated, the display package 10 of the present invention may further be configured to store printed cards that may be reoriented to display a pictorial representation of a complete product 115. Specifically, the display package may include one or more receptacles or slots configured to receive a printed card. For example, the upper section of the display package 10 (the area over the housing 105) may include a first slot and a second slot positioned adjacent one another. Each slot may be configured to receive a printed card adapted to be selectively inserted into and removed out of (or repositioned within) the its slot. The printed cards, by way of specific example, may comprise cardboard similar to that of playing/trading cards, having indicia printed on the front side and the back side of each card. The indicia printed on the card may include information relation to the complementary product portions 135A, 135B housed within the display package 10.

The indicia on each side of the printed cards may be coordinated such that when each printed card is inserted into its respective slot, both printed cards collectively provide a pictorial representation of a complete product 115. By way of example, the printed card that is received into the first slot may contain a pictorial representation of the left half of a product figure (i.e., one half of a humanoid form including the left half of the head, the left half of the torso, the left arm, and the left leg), while the printed card received by the second slot may contain a pictorial representation of the right half of a product figure (i.e., one half of a humanoid form including the right half of the head, the right half of the torso, the right arm, and the right leg). Preferably, the images of the figure halves represent various product portions contained within the shell 120 of the housing 105. To ensure the proper printed card orientation is achieved, the slots and/or printed cards may be keyed. With this configuration, a user (or buyer at the point of sale) may slide a printed card into its respective slot, providing a first display orientation (e.g., displaying only the front sides of the cards), creating a full representation of a complete product FIG. 115. The user may then remove one printed card from within its slot and either flip it over or replace the card to create alternative product representations.

Figure 4:
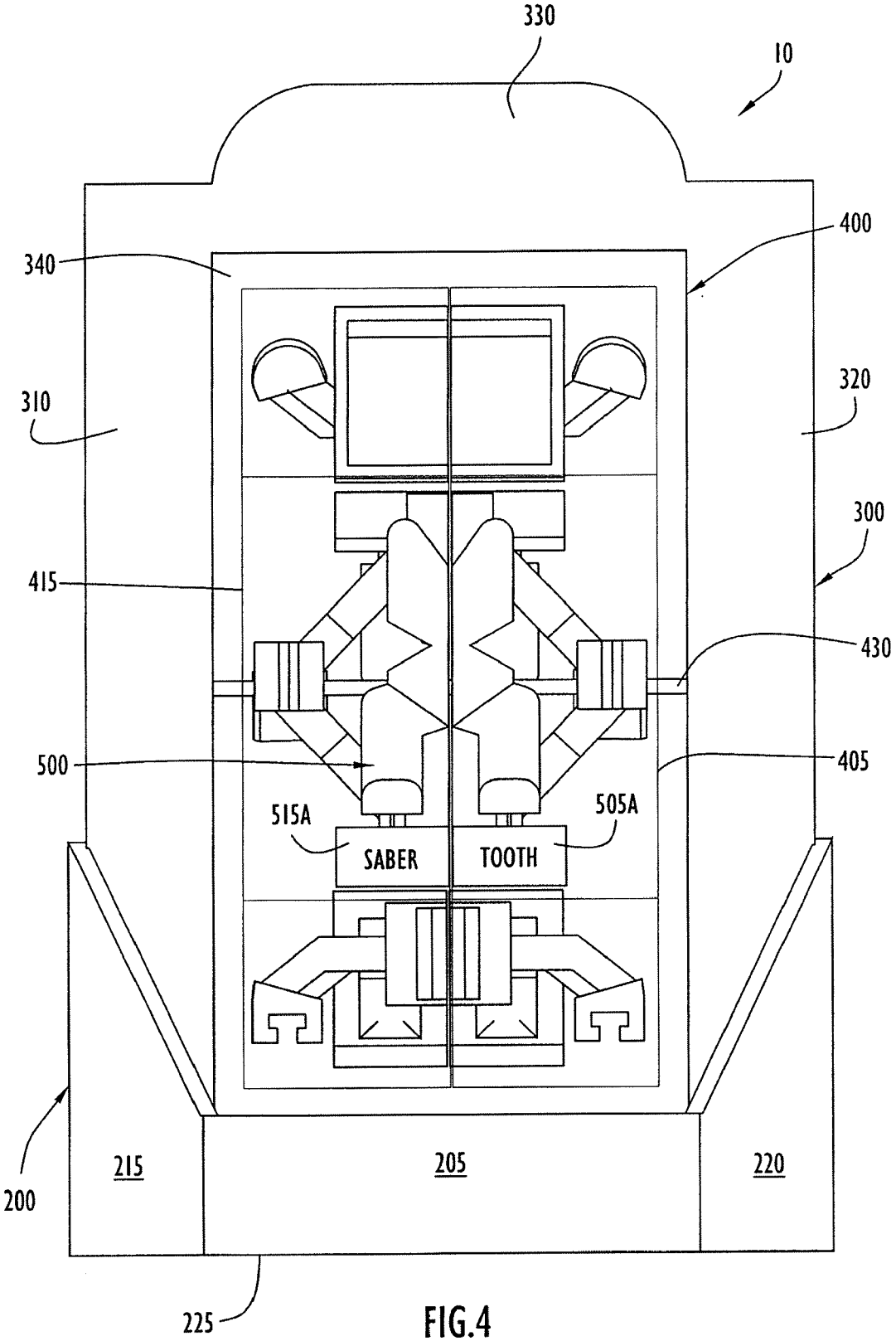
FIG. 4 illustrates a front view of a reconfigurable display package according to another embodiment of the present invention.
Figure 5:
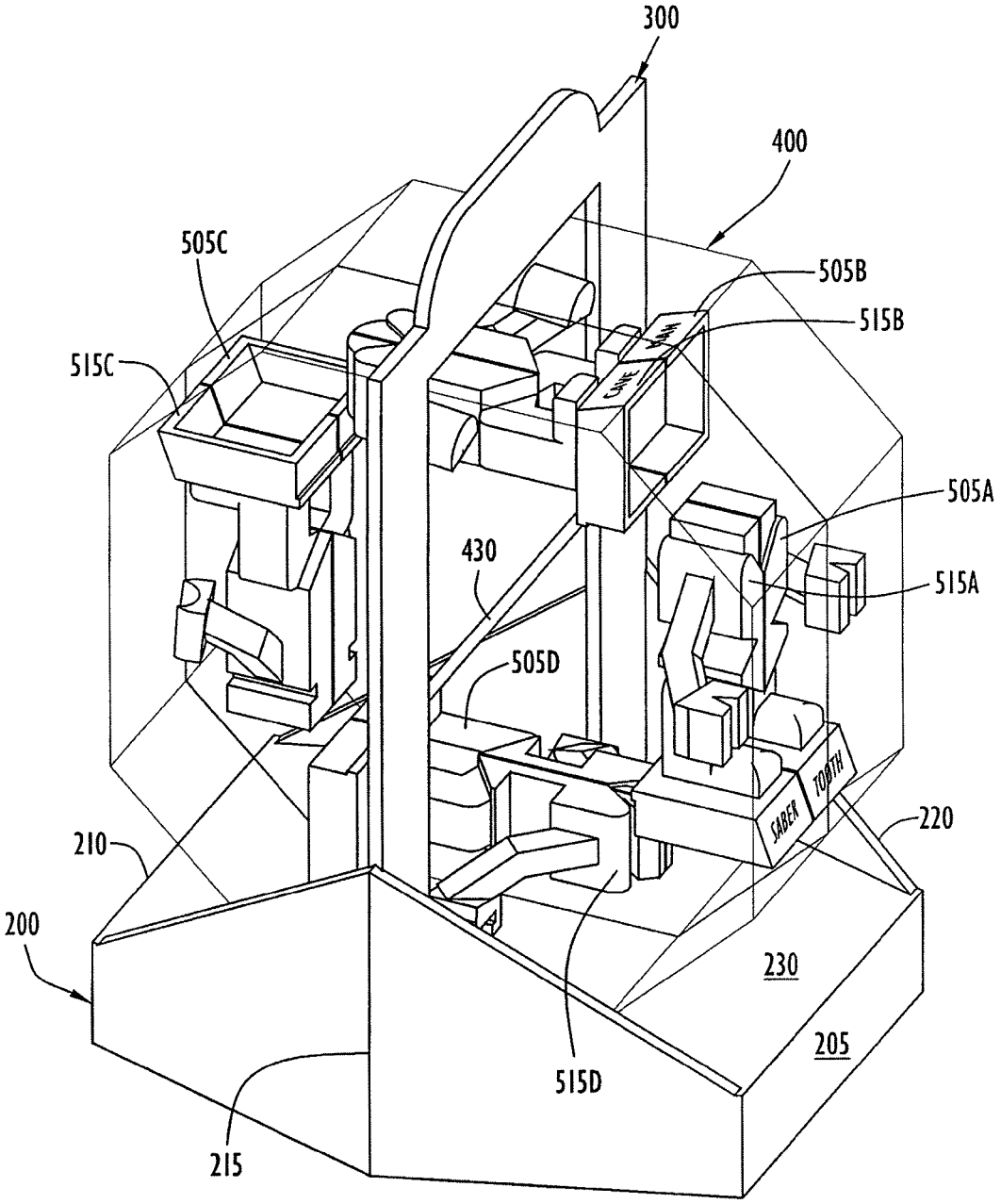
FIG. 5 illustrates a side perspective view of the reconfigurable display package of FIG. 4, showing product portions disposed within segmented portion housings.

FIG. 4 shows front view a reconfigurable display package 10 according to another embodiment of the present invention. As shown, the display package 10 may include a base 200, a frame 300, and a product housing 400 displaying a complete product 500 therein. The base 200 may include a structure configured to support the frame 300 and the product housing 400 above a supporting surface. The display package 10 is not limited to the embodiment illustrated in FIG. 4—the base 200 and/or the frame 300 may be of any shape and possess any dimensions suitable for its described purpose. FIG. 5 illustrates a left side perspective view of the reconfigurable display package 100 of FIG. 4. In the embodiment of FIGS. 4-8, the base 200 includes a generally rectangular structure having a front face 205, a rear face 210, a left sidewall 215, a right sidewall 220, a bottom face 225, and a top face 230. The base 200 may be formed from, but is not limited to, paper goods, plastics, ceramics, or other suitable materials that provide sufficient rigidity to support the reconfigurable display package 10 on a supporting surface and, in particular, to orient the product housing 400 in a substantially upright position. The base 200, however, is not limited to the embodiment illustrated in FIG. 4. For example, the base 200 may comprise any geometric shape; in addition, the left and right side walls 215, 220 may be flat, as opposed to being inclined and having a tapered surface (as illustrated in FIG. 4).

The frame 300 includes a structure configured to attach to the base 200, as well as to support the product housing 400 above the base 200. The frame 300, as shown in the embodiment of FIGS. 4-8, extends from the base 200 in a generally vertical direction. As best seen in FIG. 4, the frame 300 may comprise a first stanchion 310 and a second stanchion 320 separated by a header 330. The stanchions 310, 320 and header 330 define a central opening 340 configured to receive the product housing 400 therein (positioning the product housing 400 under the header 330 and above the base 200). The frame 300 and its stanchions 310, 320 and header 330 may be formed from any material suitable to support the housing 400. By way of example, the stanchions 310, 320, and header 330 may be formed from cardboard, plastic, wood, etc.

The product housing 400 may include a structure configured to house one or more product portions (where multiple product portions (at least two) are placed in an adjacent relationship to form a complete product 500), as well as to reposition the product portions with respect to each other such that the display of multiple configurations of a complete product may be achieved. The product housing 400 may be formed from, but is not limited to, transparent, translucent, and/or opaque materials. As an example, the product housing 400 may be formed from a transparent material such as a plastic (e.g., a "blister pack"). Referring again to FIG. 4, the product housing 400 may include a structure comprising a first housing segment 405 and a second housing segment 415. The first and second housing segments 405, 415 of the product housing 400 may be at least partially disposed within the central opening 340 of the frame 300. As illustrated in FIGS. 4 and 5, the housing segments 405, 415 may be coupled to the frame 300 using an axle 430 extending from the first stanchion 310, through the housing segments 405, 415 (e.g., proximate their radial centers), to the second stanchion 320. With this configuration, the axle 430 provides a common axis for the first and second housing segments 405, 415.

The axle 430 may be secured to the frame 300 by conventional means (e.g., adhesives, brackets, etc.) such that the axle 430 is stationary with respect to the frame stanchions 310, 320. The housing segments 405, 415, however, may be singly or collectively secured to the axle 430 such that the housing segments 405, 415 rotate thereon. In the embodiment shown in FIGS. 4 and 5, both the first housing segment 405 and the second housing segment 415 are adapted to independently rotate on the axle 430, and thus the housing segments 405, 415 are capable of rotating one set of product portions with respect to another set of product portions (discussed in greater detail below).

The housing segments 405, 415 may be of any size and shape. As best seen in FIG. 5, in the illustrated embodiment, the housing segments 405, 415 have a generally polygonal shape (an irregular octagon (consisting of four equal length long sides and four equal length short sides)). Each housing segment 405, 415 may be divided or segmented into individual compartments, with each compartment storing a product portion. By way of specific example, and as best seen in FIG. 5, the first housing segment 405 may include four compartments respectively containing a first set of product portions 505A, 505B, 505C, and 505D. Similarly, the second housing segment 415 may include four compartments containing a second set of product portions 515A, 515B, 515C, and 515D. Preferably, the first set of product portions 505A, 505B, 505C, and 505D contained in the first housing segment 405 is complementary to the set of product portions 515A, 515B, 515C, and 515D contained in the second housing segment 415 (discussed in greater detail below).

Figure 6:
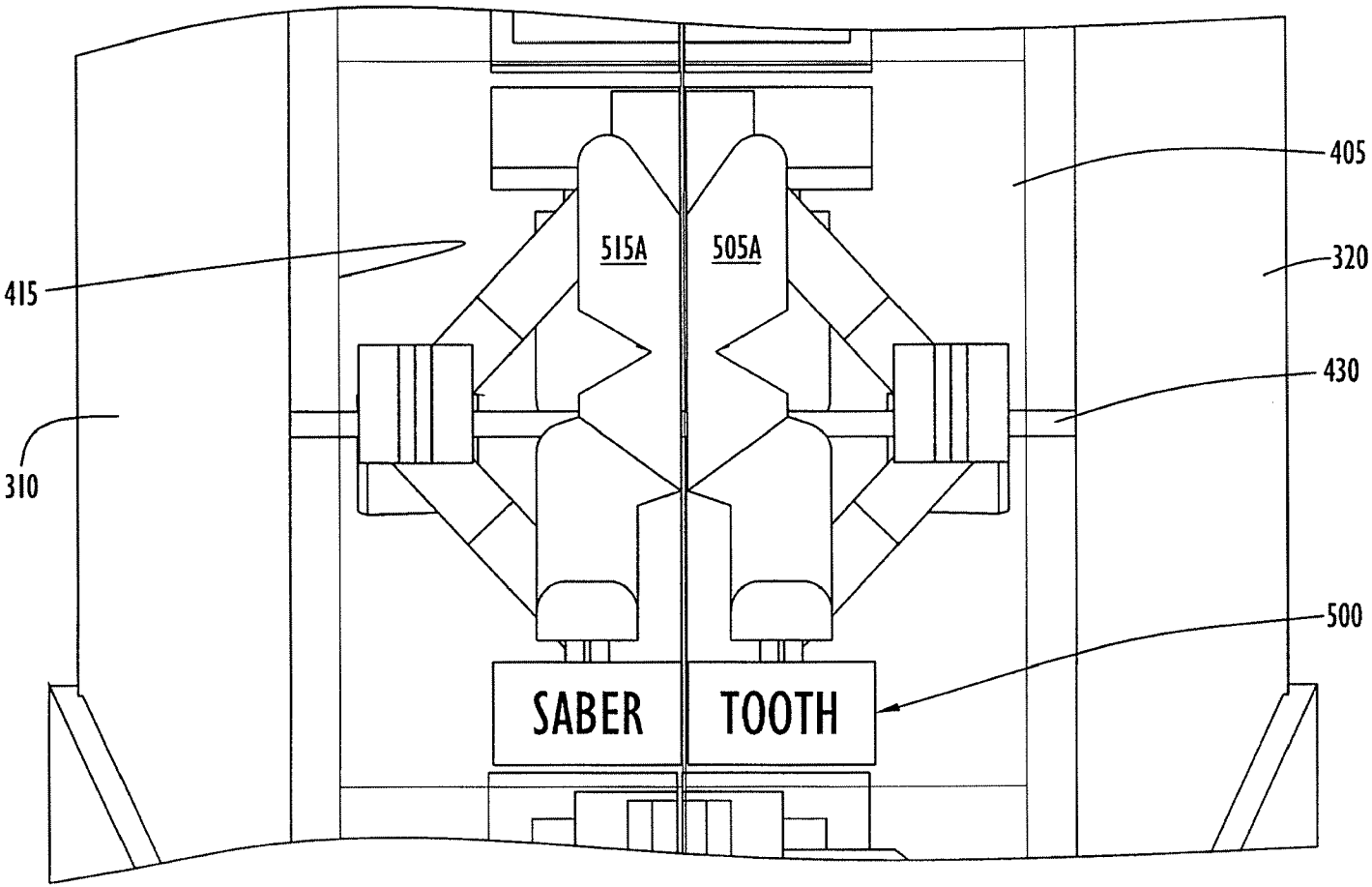
FIGS. 6-8 illustrate the reorientation of the reconfigurable display package of FIG. 4. Specifically.

Each set of product portions 505A-D, 515A-D, etc. may be secured within its respective compartment or segment within housing segments 405, 415 in a predetermined position to enable the display of a complete product 500. That is, each product portion 505A-D, 515A-D may be oriented within a housing segment 405, 415 such that when the housing segments are placed in a display position (e.g., in FIG. 4, along the front 205 of the display package 10), the two individual product portions—one from the set contained in first housing segment 405 and one from the set contained in the second housing segment 415—are positioned adjacent each other, appearing to display a single complete product 500. By way of specific example, in FIG. 6, showing a close-up view of the front side of the product housing 400, the first housing segment 405 may include product portions 505A, 505B, 505C, and 505D forming the right (from the point of view of FIG. 4) side of a toy figure (i.e., one half of a humanoid form including the right half of the head, the right half of the torso, the right arm, and the right leg). Complementarily, the second housing segment 415 may include individual product portions 515A, 515B, 515C, and 515D, each forming the left (from the point of view of FIG. 4) side of a toy figure (i.e., one half of a humanoid form including left half of the head, the left half of the torso, the left arm, and the left leg).

Figure 7:
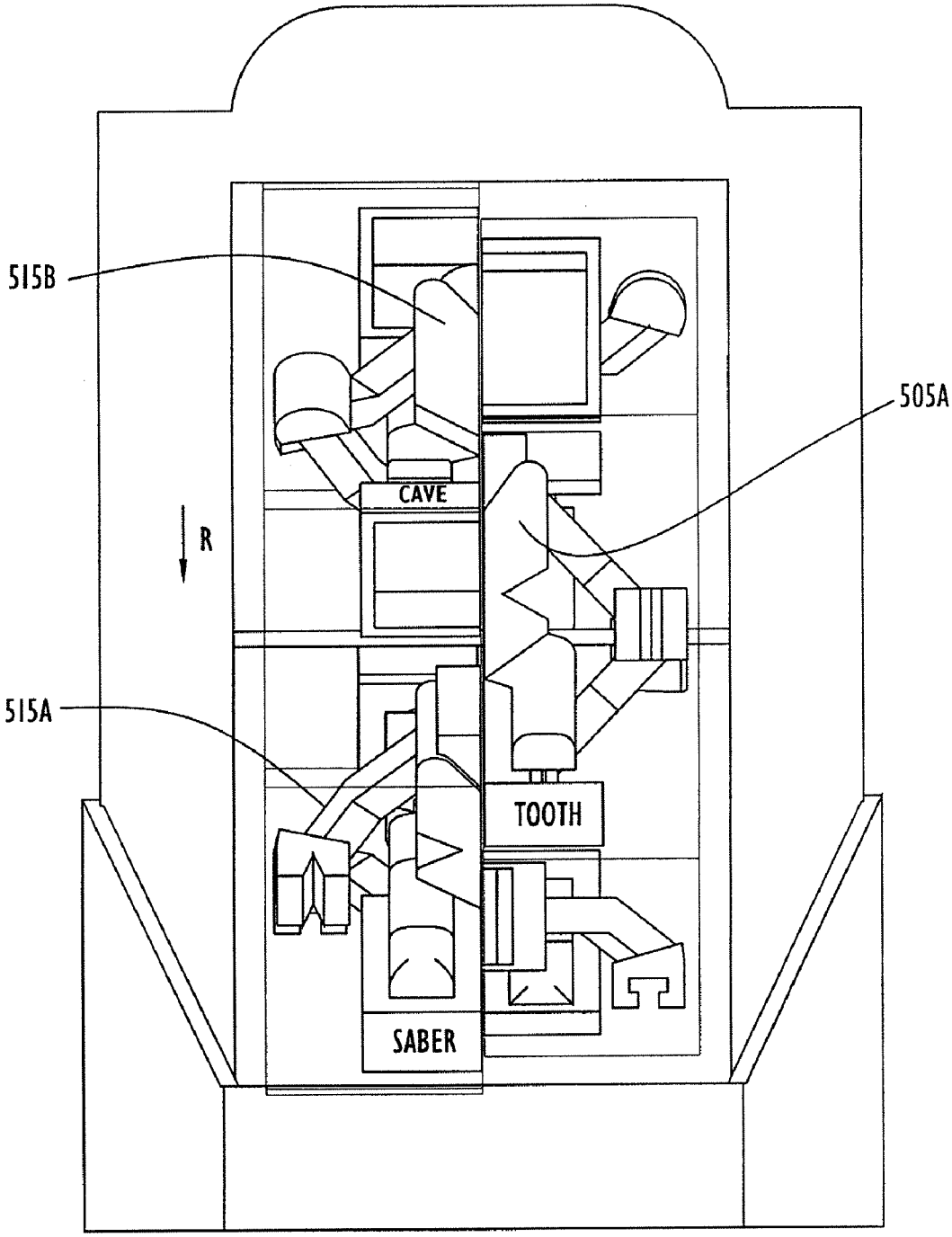
Figure 8:
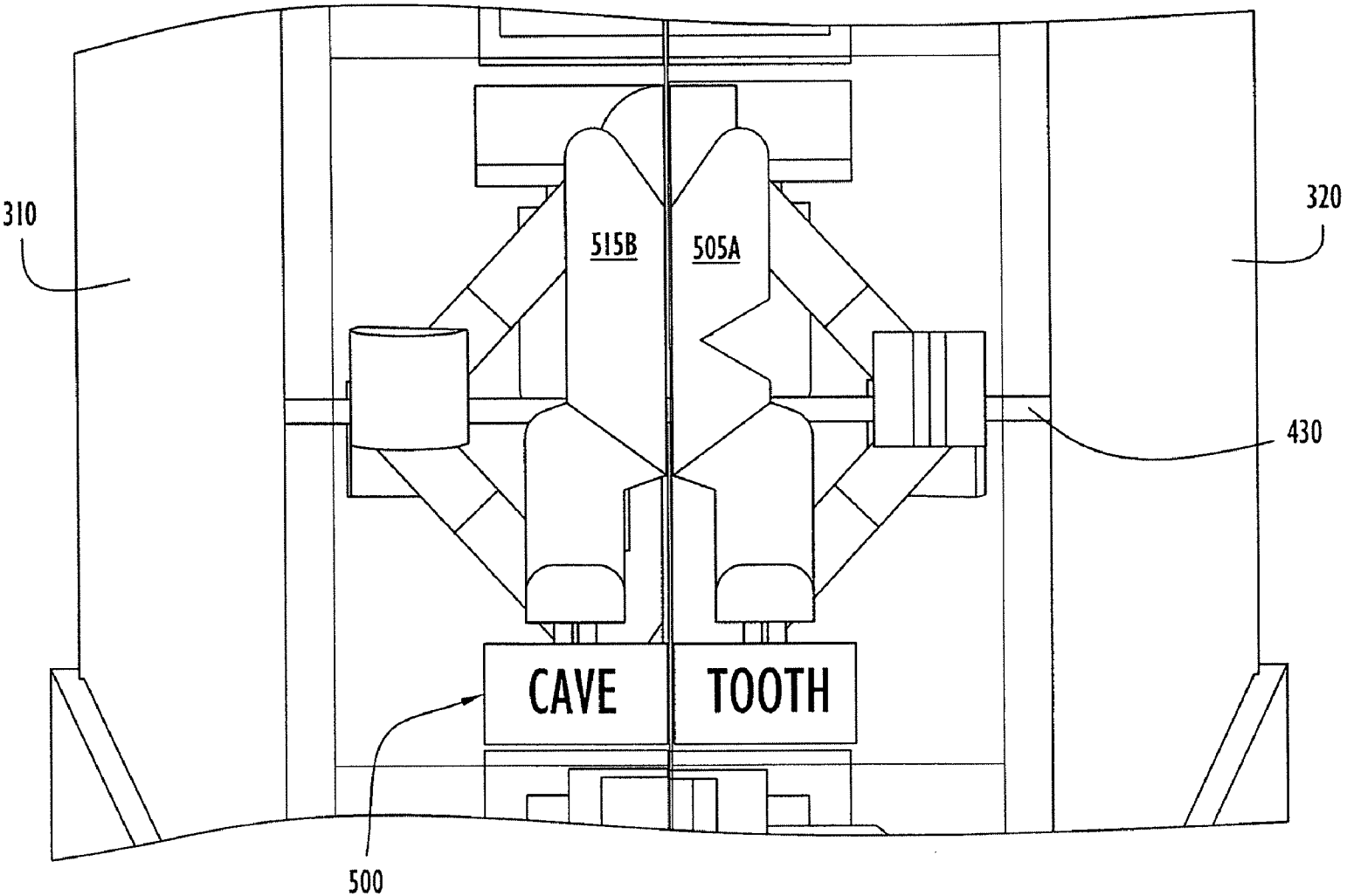

As discussed above, the first and second product housings 405, 415 are capable of rotation with respect to each other; consequently, the individual portions of each product set 505A-D, 515A-D may be rotated into the display position (e.g., where a complete product 500 is displayed in the front of the reconfigurable display package 10). Thus, the individual product portions 505A-D, 515A-D may be realigned to match various right figure halves with various left figure halves. FIGS. 6-8 illustrate the reorientation of the first and second housing segments 405, 415, and thus, the product portions 505A-D, 515A-D utilizing the reconfigurable display package 10 in accordance with the present invention. As shown in FIG. 6, the complete product 500 is displayed in a first display orientation, wherein a figure left half 515A ("Saber") and its complementary right half 505A ("Tooth") are displayed to form a complete FIG. 500 ("Saber-Tooth"). In operation, the first and second product housings 405, 415 may be rotated upward or downward to reorient the left half 515A and right half 505A of the figures with respect to each other. Consequently, as shown in FIG. 7, the first product portion 405 may remain stationary, while the second housing segment 415 is rotated (as indicated by arrow R), displacing the figure left half 515A ("Saber"). The second housing segment 415 may rotated until it is positioned in a second display orientation, wherein a different figure left half 515B ("Cave") is aligned with the original right figure half 505A ("Tooth"), displaying a different complete FIG. 500 ("Cave-Tooth") having an appearance different from the first figure as shown in FIG. 8. This process may be continued, with the various figure left halves 515A-D (i.e., product components in the second housing segment 415) being selectively aligned with the various figure right halves 505A-D (i.e., the product components in the first housing segment 405) to display multiple orientations of the complete product 500 (i.e., entire figures with body halves of the same or different mirror images).

As discussed above, the second housing segment 415 may be rotated with respect to the first housing segment 405. Alternatively, the first housing segment 405 may be rotated with respect to the second housing segment 415, or both housing segments 405, 415 may be rotated with respect to each other in order to configure and display the desired complete FIG. 500 in the display positions of FIGS. 4 and 8. That is, the rotation of the housing segments 405, 415 is not limited to that which is described above, namely, where the second housing segment 415 rotates with respect to the first housing segment 405 to alter the appearance of product 500. In addition, the first housing segment 405 may be rotated about the axle 430 to produce similar results. Furthermore, rotation is not limited to the direction of the arrow R (FIG. 7). For example, both the first and second housing segments 405, 415 may be adapted to rotate in both the upward and/or downward directions.

To secure the product housing 400 in a desired display position, the first and second housing segments 405, 415 may frictionally engage any one or more of the base 200, the frame 300, and/or the first 405 and second 415 housing segments themselves. Alternatively, each of the housing segments 405, 415 may include one or more tabs (not illustrated) extending radially from their periphery (not illustrated). The tabs may be configured to engage one or more of the header 330, the stanchions 310, 320 and/or the base 200 to secure the housing segments 405, 415 in a desired position.

Figure 9:
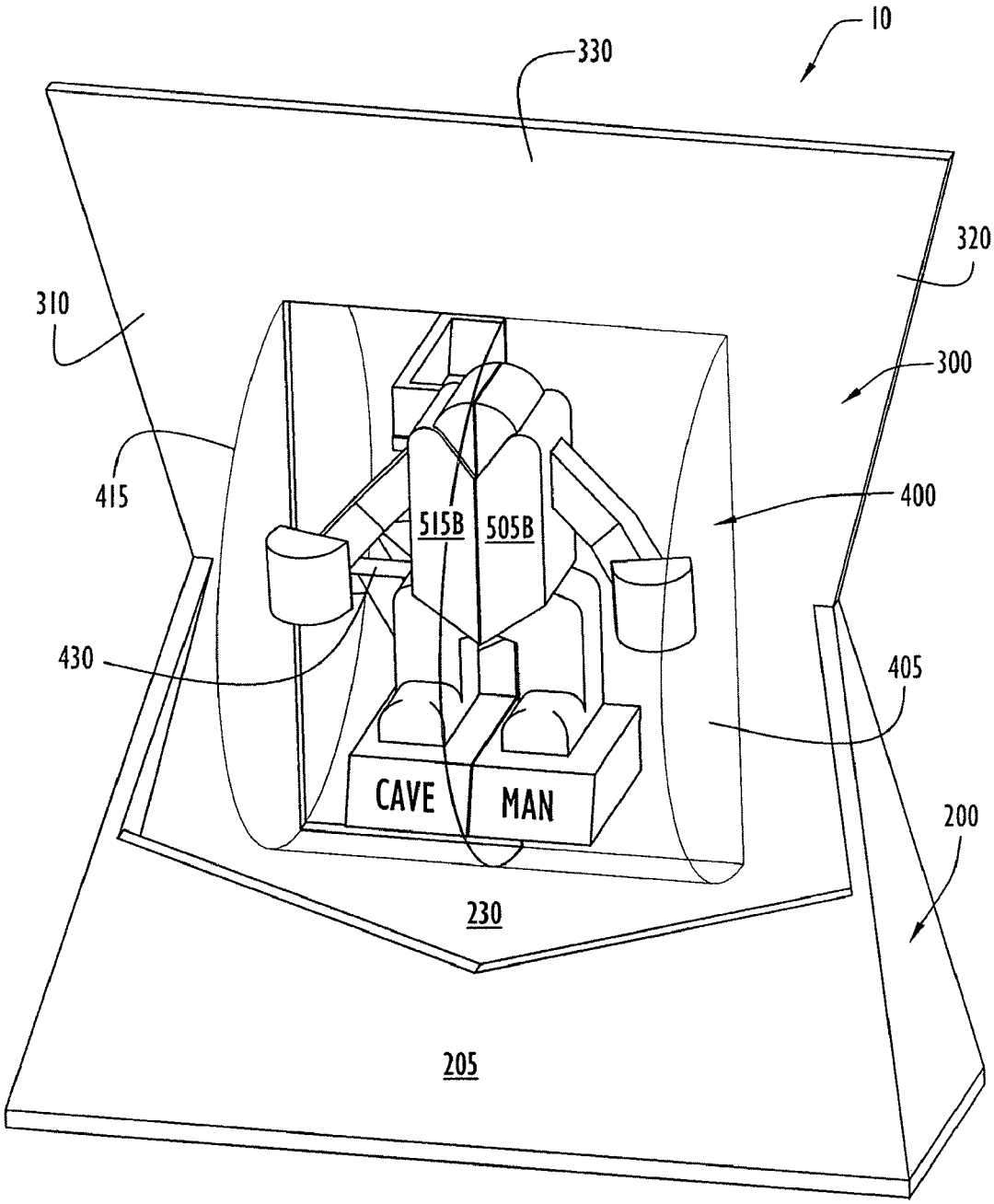
FIG. 9 illustrates a front perspective view of the reconfigurable display package according to yet another embodiment of the present invention, showing a complete product displayed in a first configuration.

FIG. 9 illustrates a reconfigurable display package 10 according to another embodiment of the invention. As shown, the reconfigurable display package 10 may include a base 200, a frame 300, and a product housing 400 including a first housing segment 405 and a second housing segment 415. The base 200 is similar to that described above; however, the frame 300 and the product housing 400 are adapted to permit the rotation of only one of the housing segments (i.e., either the first housing segment 405 or the second housing segment 415—in this Figure, only housing segment 415 rotates). Briefly, the product housing 400 may comprise materials similar to those noted above. The first housing segment 405 may comprise a generally rounded shape including a single compartment containing one product portion 505B. The second housing segment 415 may include two compartments containing a multiple product portions 515A and 515B (seen best in FIGS. 10 and 11). The product portions 505B, 515A, and 515B are similar to those described above in that each may comprise either the right side of a toy figure (i.e., one half of a humanoid form including right half of the head, the right half of the torso, the right arm, and the right leg) or the left side of a toy figure (i.e., one half of a humanoid form including left half of the head, the left half of the torso, the left arm, and the left leg).

Figure 10:
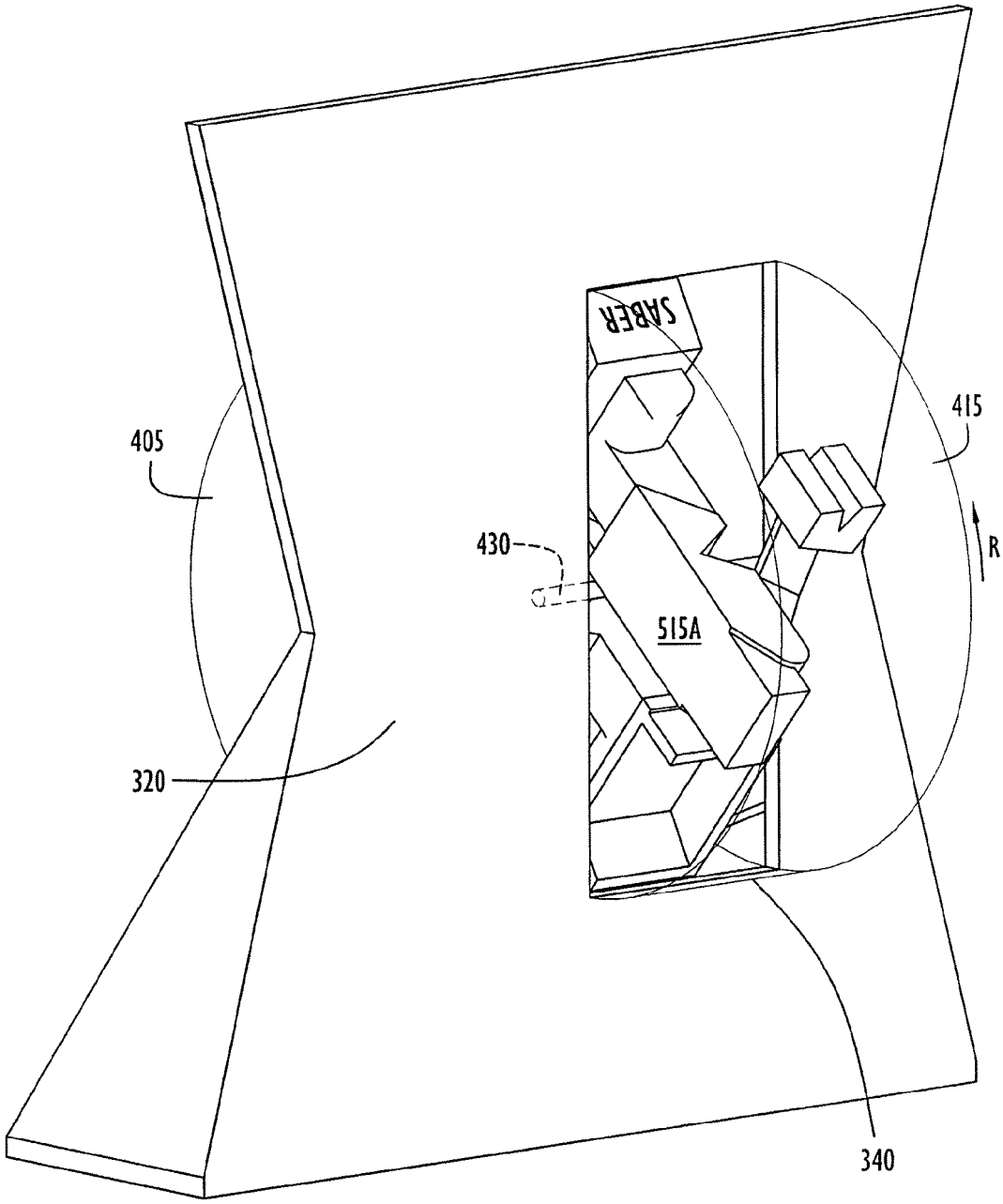
FIG. 10 illustrates a rear perspective view of the reconfigurable display package of FIG. 9, showing the reorientation mechanism.

FIG. 10 is a rear perspective view of the reconfigurable display package 10 of FIG. 9. As shown in the illustrated embodiment, the opening 340 has been modified to permit only the second housing segment 415 to extend therethrough. As with the embodiment described above, the second housing segment 415 may be rotatably coupled to the frame 300 using an axle 430 secured to the left and right stanchions 310, 320. In contrast to the above embodiment, the first housing segment 405 may fixed. As best seen in FIG. 9, the first housing segment 405 may comprise a structure secured to the front surface of the frame 300 and, in particular, to the second stanchion 320 (which may be wider than first stanchion). As indicated above, the first housing segment 405 may include a single product portion 505B comprising the right (from the point of view of FIG. 9) side of a toy figure (i.e., one half of a humanoid form including the right half of the head, the right half of the torso, the right arm, and the right leg) positioned such that the product portion 505B of the first housing segment 405 may be aligned with either of the product portions 515A, 515B of the rotatable second housing segment 415. Since the second housing segment 415 is rotatably coupled to the frame 300 along the axle 430, the second housing segment 415 can be reoriented with respect to the first housing segment 405. Consequently, the product portions 515A, 515B of the second housing segment 415 may be aligned (and re-aligned) with the product portion 505B of the first housing segment 405 to display a complete toy FIG. 500 in multiple configurations.

Figure 11:
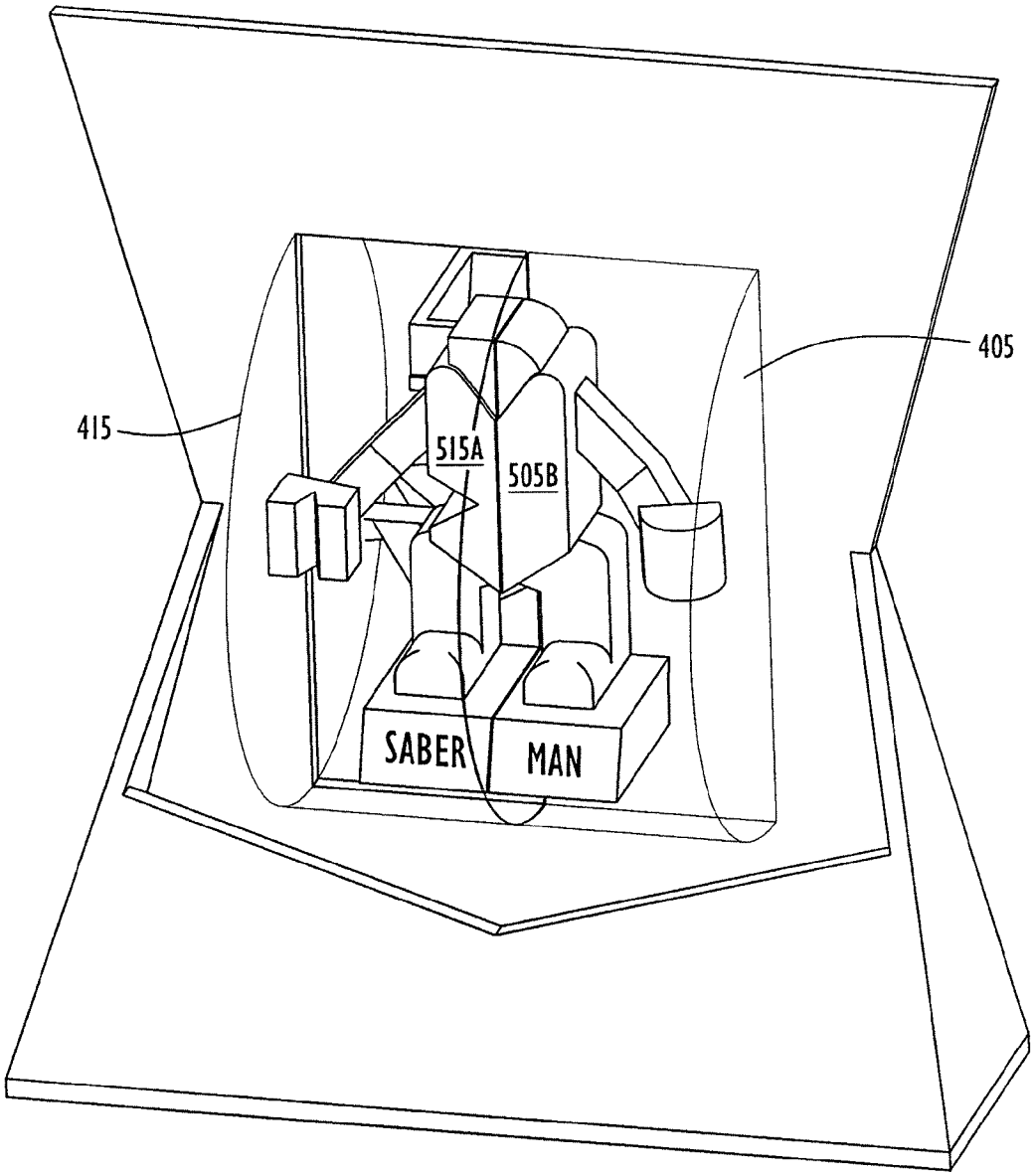
FIG. 11 illustrates a front perspective view of the reconfigurable display package of FIG. 9, showing a complete product displayed in a second configuration.

The operation of the reconfigurable display package 10 is explained with reference to FIGS. 9-11. Referring first to FIG. 9, the display package 10 is oriented in a first display configuration, with the one product portion (figure left half 515B ("Cave")) aligned with a complementary product portion 505B (figure right half ("Man")) to display a complete FIG. 500 ("Cave-Man"). The second housing segment 415 may be rotated (indicated by R in FIG. 10) to reorient the figure halves 505B, 515B with respect to each other. Consequently, as shown in FIGS. 9 and 11, the first housing segment 405, being stationary, remains in position, while the second housing segment 415 is rotated to displace the product portion 515B (the figure left half ("Cave")). Referring to FIG. 11, the rotation of the second housing segment 415 may continue until the product portion 515A (i.e., the figure left half ("Saber")) aligns with the stationary (original) figure right half 505B ("Man") to orient the display package 10 in a second display configuration, showing the user a complete FIG. 500 (now "Saber-Man") having an appearance different from the originally displayed complete FIG. 500. If additional product portions are present within the second housing segment 415, this process may continue, with the various figure left halves 515A-D being selectively aligned with the figure right half 505B. In this manner, multiple display configurations of the complete product 500 (i.e., entire figures comprising the same or different mirror image halves) may be selectively provided.

Figure 12:
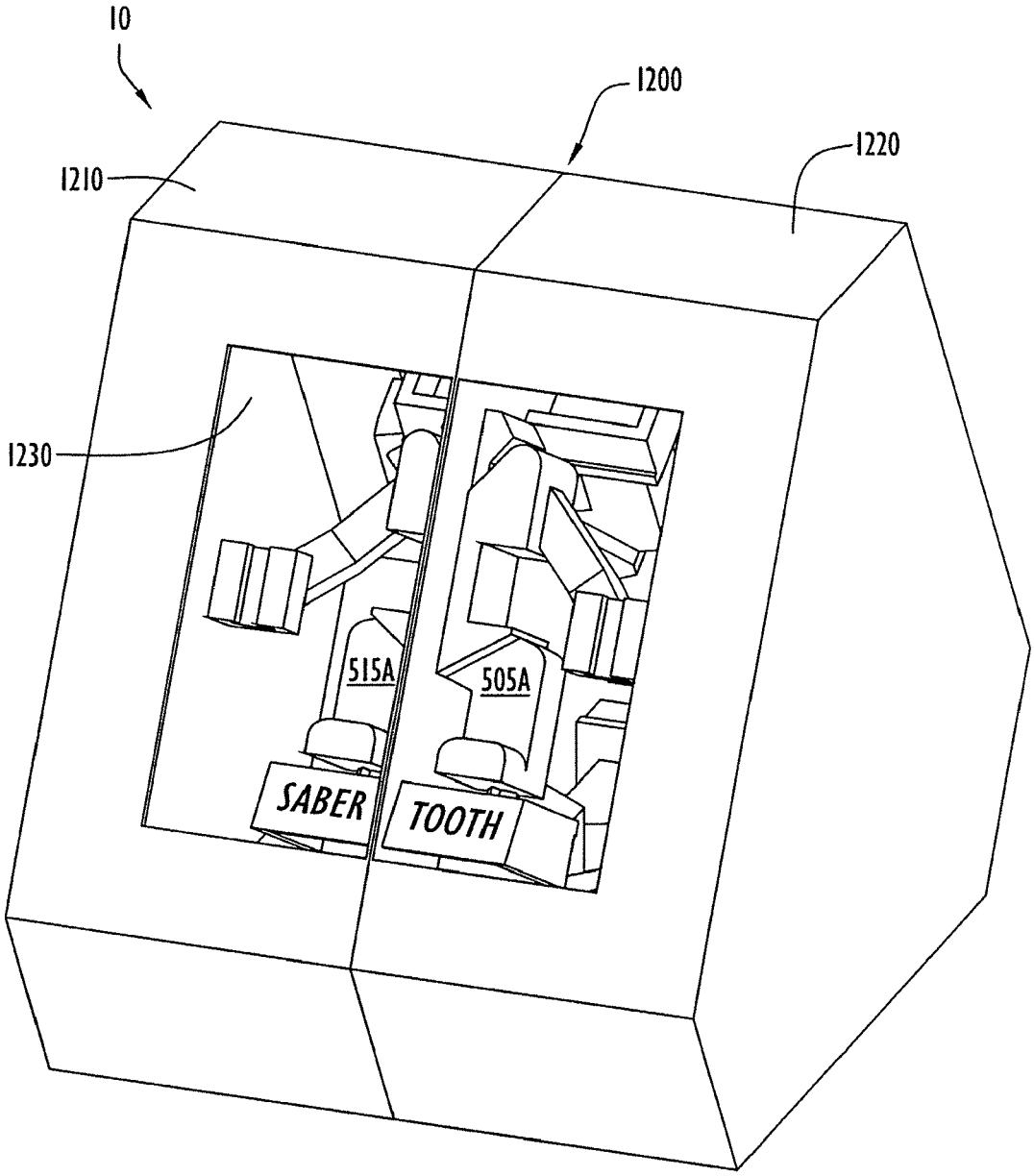
FIG. 12 is a front perspective view of the front of a reconfigurable display package according to yet another embodiment of the present invention, showing a complete product displayed in a first configuration.
Figure 13:
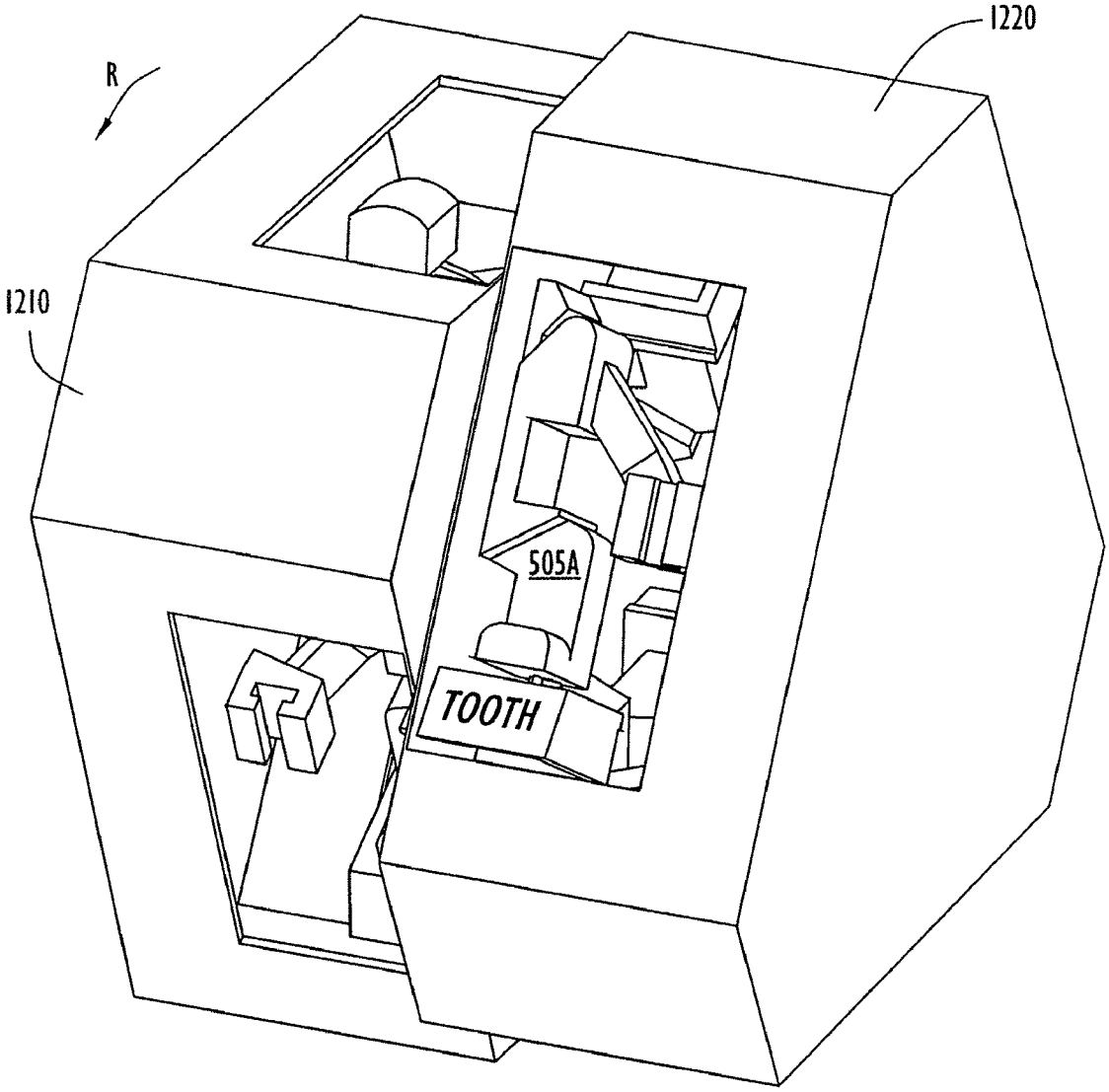
FIG. 13 illustrates a front perspective view of the reconfigurable display package of FIG. 12, showing reorientation of the product portions.
Figure 14:
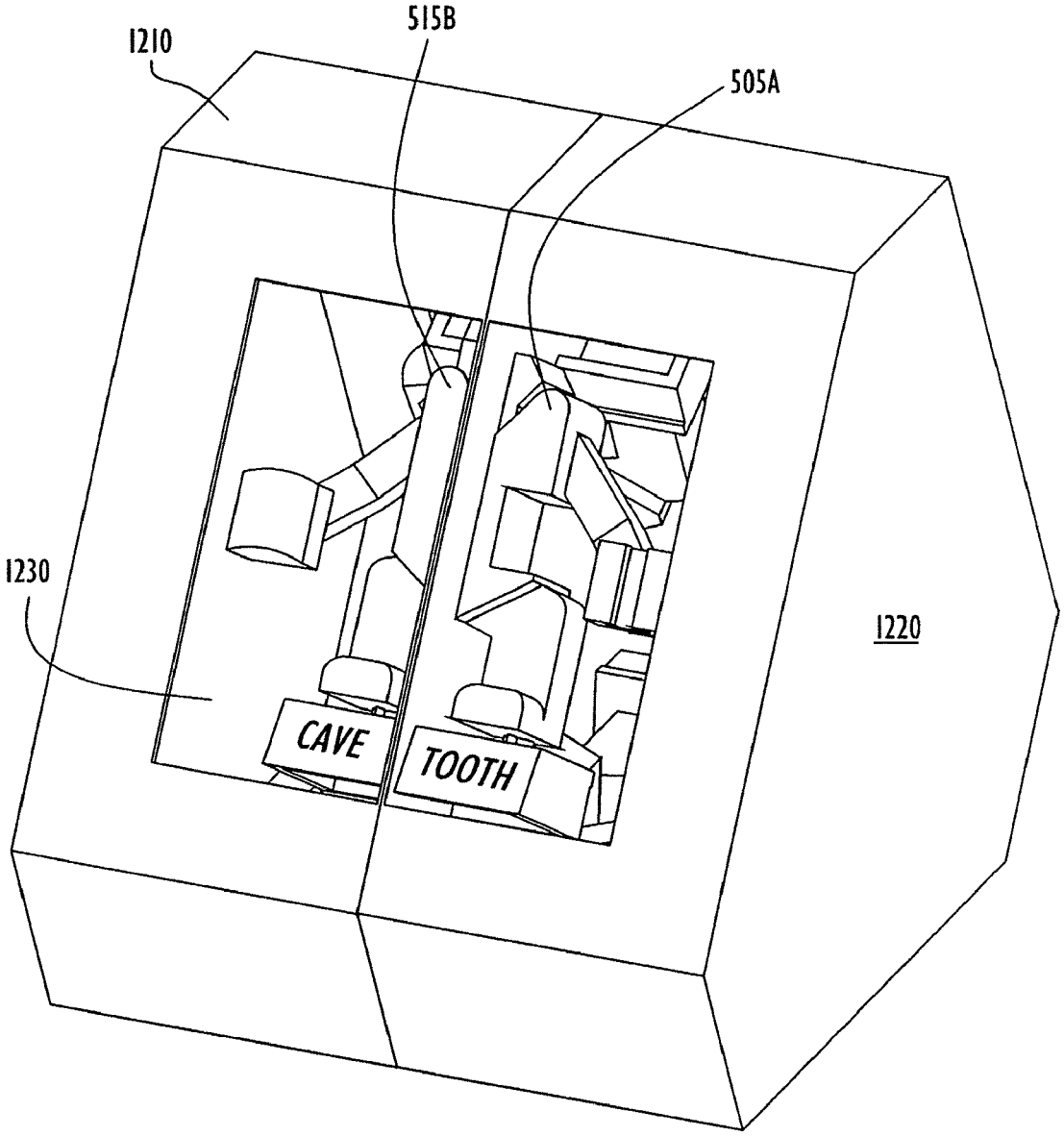
FIG. 14 illustrates the reconfigurable display package of FIG. 12, showing a complete product displayed in a second configuration.

FIGS. 12-14 illustrate front perspective views of a reconfigurable display package according to yet another embodiment of the present invention. As shown, the display package 10 may in include a housing 1200 including a first compartment 1210 rotatably coupled a second compartment 1220. Each compartment 1210, 1220 may be formed into a polygon, with each face of the polygon containing a transparent window 1230. By way of example, the display package 10, and thus each compartment 1210, 1220, may possess a generally triangular shape. Each compartment, furthermore, may house product portions 505A-D, 515A-D such that they are viewable through the windows 1230. The product portions 505A-D, 515A-D are disposed within the compartments such that, when the compartments 1210, 1220 are aligned, complementary product portions (e.g., a figure left half and a figure right half) become aligned, creating a complete product 500 viewable through the windows 1230. It is important to note that each face of the polygon, since it contains a window 1230, displays a completed product viewable by a user. In addition, the appearance of the displayed (complete) product 500 may be altered by selectively rotating the first compartment 1210 with respect to the second compartment 1220 (and vice versa).

Operation of the display package is explained with reference to FIGS. 12-14. Referring first to FIG. 12, the display package 10 begins in a first display position, with the first product portion (figure left half 515A ("Saber")) aligned with a figure right half 505A ("Tooth") to display a complete FIG. 500 ("Saber-Tooth"). The first compartment 1210 may be rotated (indicated by R in FIG. 13) to reorient the figure halves 505A, 515A with respect to each other. The rotation of the first compartment 1210 may continue until the second product portion 515B (i.e., the figure left half ("Cave")) aligns with the stationary (original) figure right half 505A ("Tooth") to display the product in a second display configuration, showing the user a complete FIG. 500 having an appearance different from the originally displayed figure (now "Cave-Tooth"). If additional product portions are present within the second housing segment (first compartment 1210), this process may continue, with the various figure left halves 515A-D being selectively aligned with various figure right halves 505A-D, and vice versa, to provide multiple display configurations of the complete product 500 (e.g., toy figures comprising the same or different mirror image halves).

Figure 15:
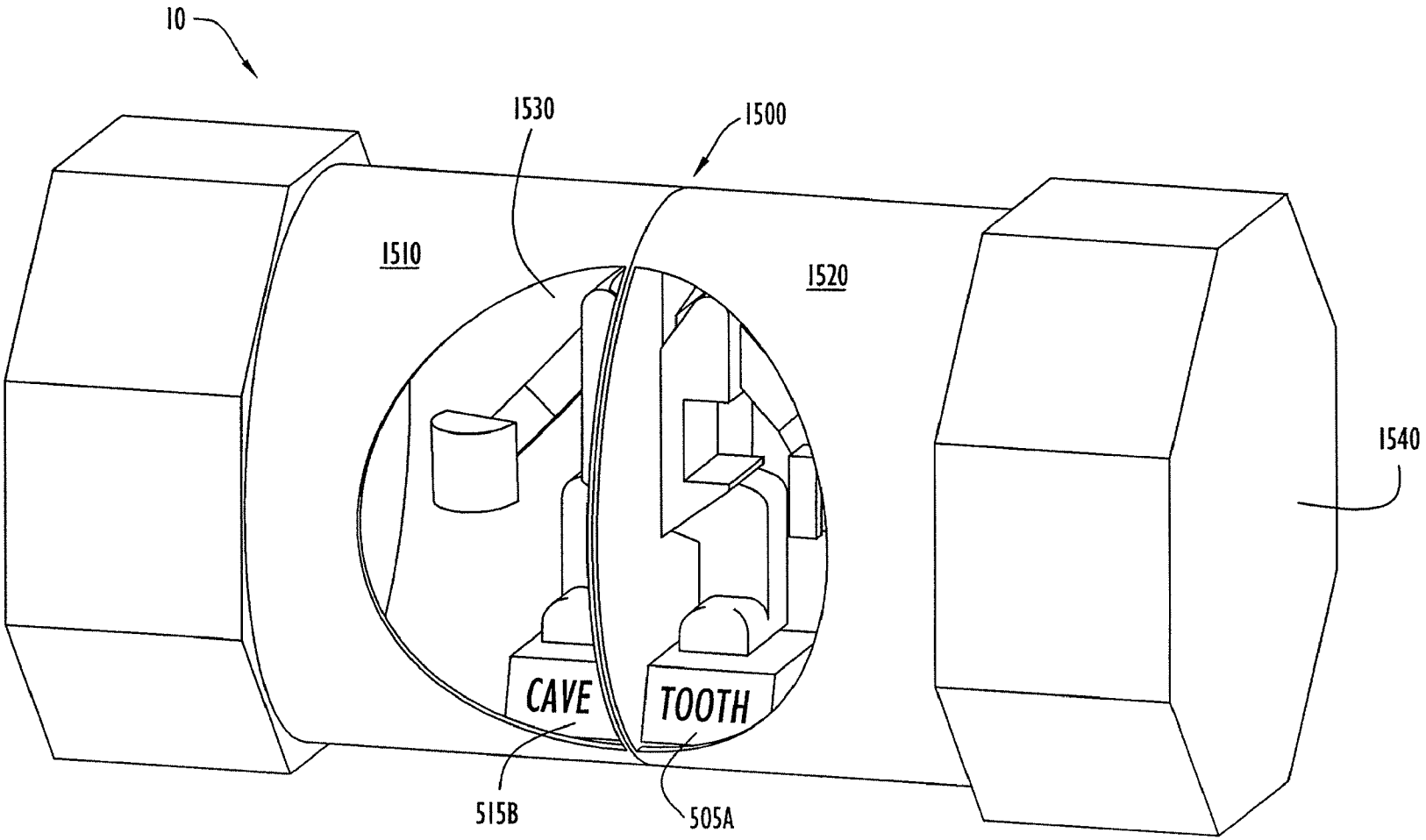
FIG. 15 illustrates a perspective view of the front side of a reconfigurable display package according to yet another embodiment of the present invention.
Figure 16:
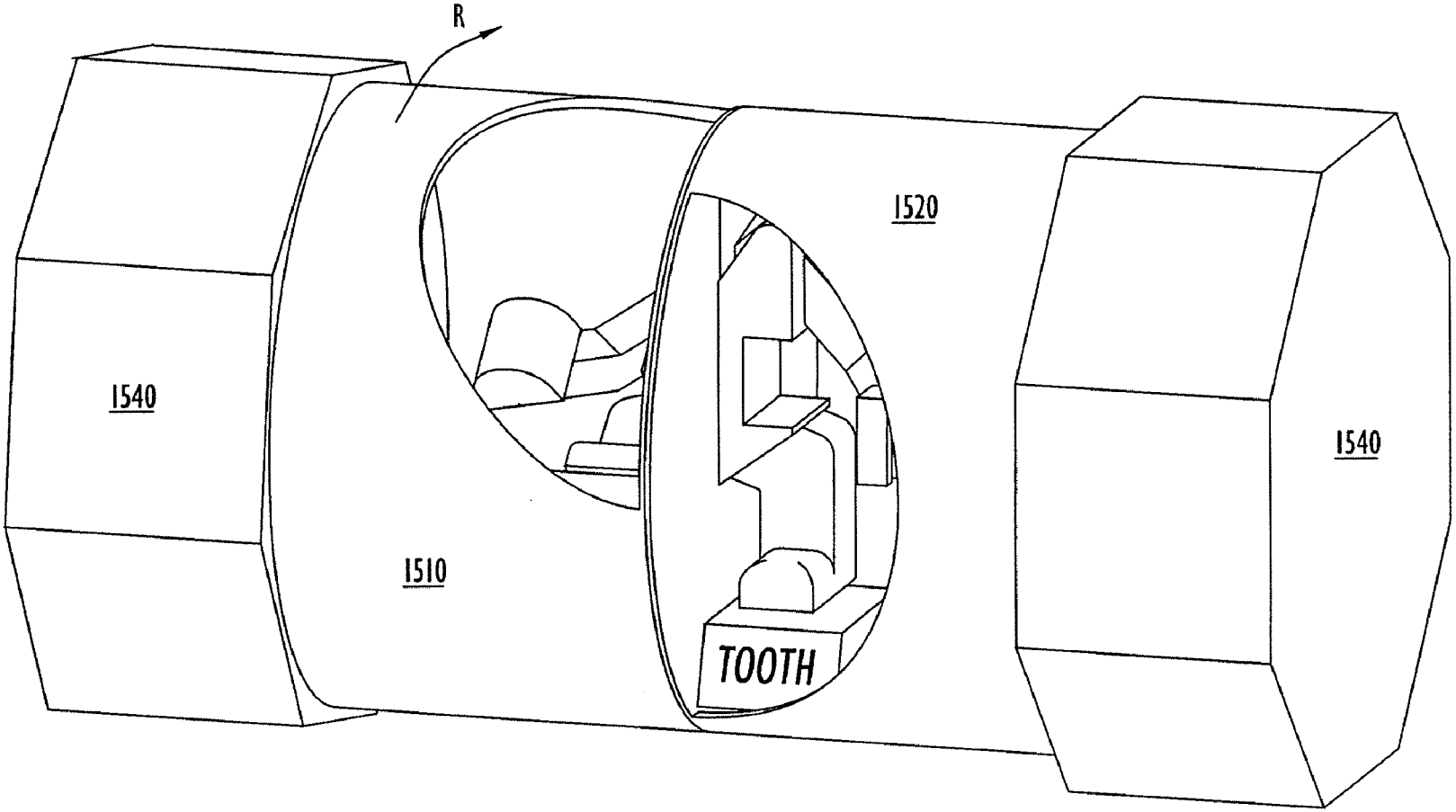
FIG. 16 illustrates the reconfigurable display package of FIG. 15, showing reorientation of the product portions.

FIGS. 15 and 16 illustrate a reconfigurable display package according to yet another embodiment of the present invention. The display package 10 is similar to that described above with reference to FIGS. 12-14. The display package, however, instead of have a polygonal shape, comprises a generally cylindrical shape including a housing 1500 with a first compartment 1510 and a second compartment 1520, each including a plurality of windows 1530 through which product portions 505A-D, 515A-D may be viewed. The compartments 1510, 1520 are rotatably coupled; consequently, the display package 10 may be reoriented from a first display configuration (as illustrated in FIG. 15) to a second display configuration (see FIG. 16 showing the transformation between configurations). The display package 10 may further include gripping members 1540 disposed on each compartment 1510, 1520 to assist a user in rotating the first compartment 1510 with respect to the second compartment 1520, and vice versa.

Figure 17:
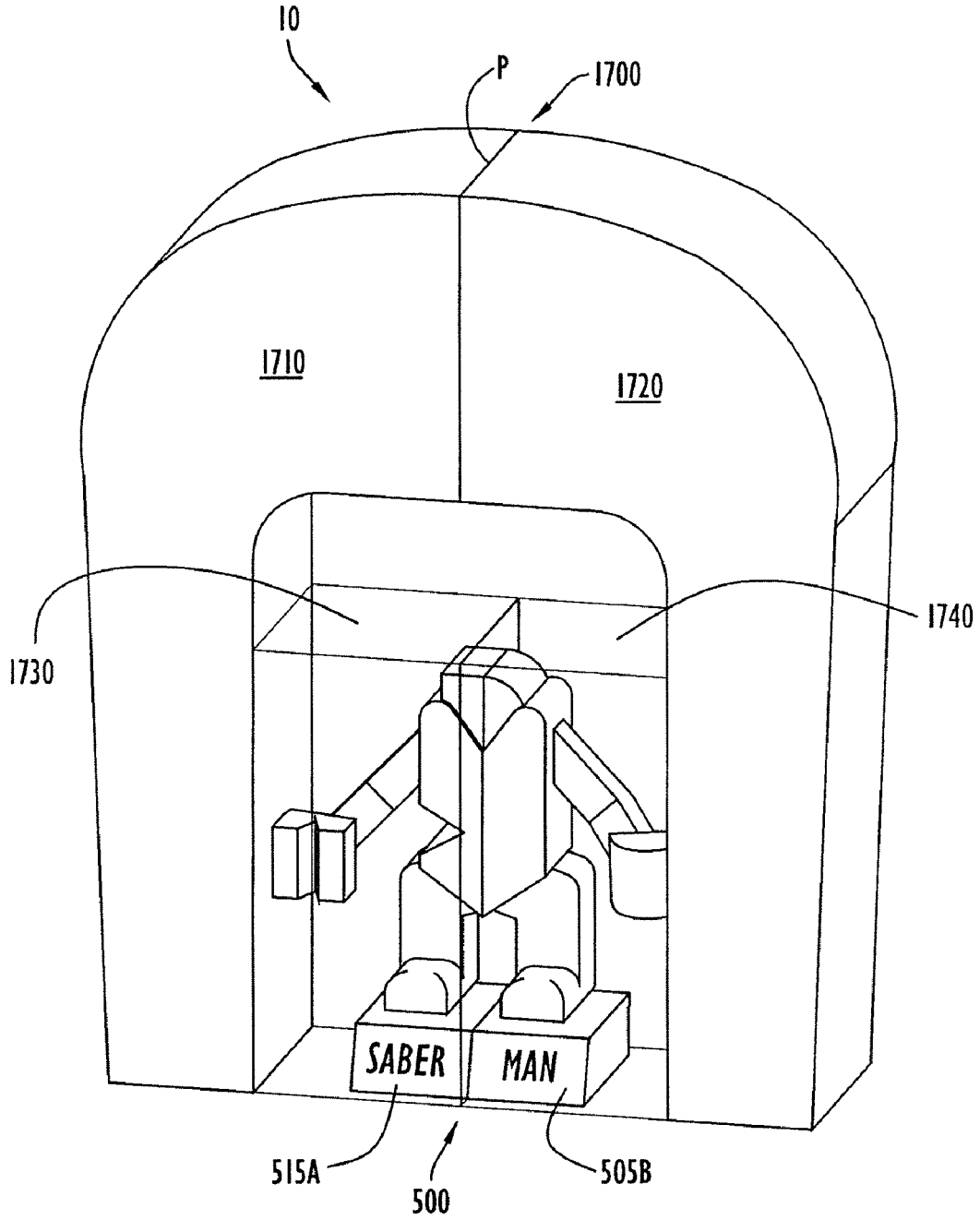
FIG. 17 illustrates a perspective view of the front of a reconfigurable display package according to yet another embodiment of the present invention, showing product portions in a first display position.
Figure 18:
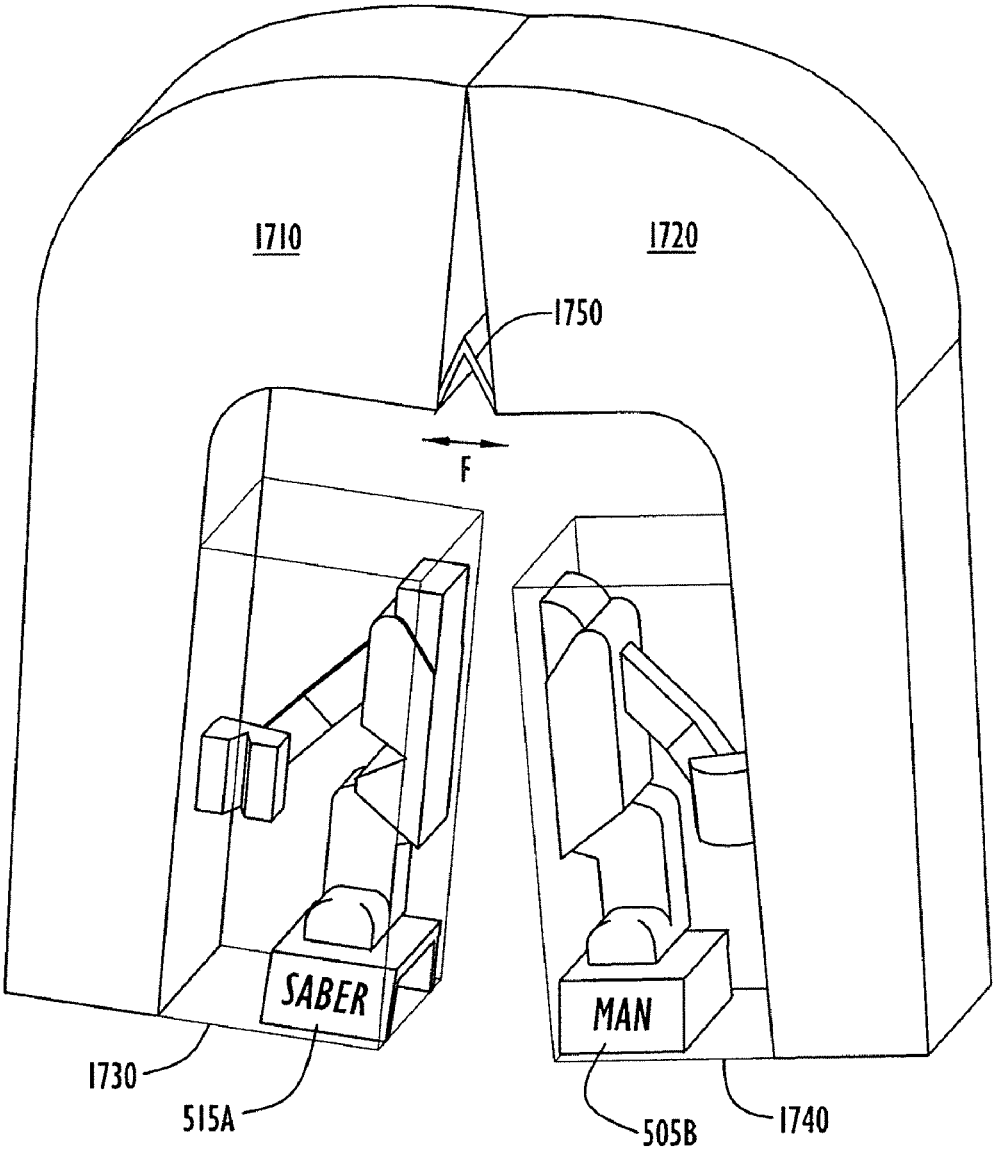
FIG. 18 illustrates the reconfigurable display package of FIG. 17, showing product portions in a second display position.

FIGS. 17 and 18 illustrate a reconfigurable display package according to yet another embodiment of the present invention. As illustrated, the display package 10 may have a generally U-shaped frame 1700 including a first stanchion 1710 pivotally connected to a second stanchion 1720 along pivot point P. The display package 10 may further include a first transparent housing 1730 coupled to the first stanchion 1710 and a second transparent housing 1740 coupled to the second stanchion 1720. The first transparent housing 1730 may contain one product portion 515A (figure left half ("Saber")). Similarly, the second transparent housing 1740 may contain a product portion 505B complementary to the product portion 515A in the first transparent portion (i.e., figure right half ("Man")).

With the above configuration, the display package 10 may be reoriented from a first display configuration, wherein the product portions 505B, 515A are positioned adjacent each other, to a second display position, wherein the product portions are spaced/separated from each other. Specifically, referring to FIG. 17, the display package 10 begins in its first display position. In the first display position, the first housing 1730 abuts the second housing 1740, presenting to the viewer a complete product 500. The first stanchion 1710 may be pivoted away from the second stanchion 1720 along pivot point P (and/or vice versa) by applying a force F to move the first housing 1730*a* predetermined distance away from the second housing 1740, separating the product portions 505B, 515A (as illustrated in FIG. 18). The frame 1710 may further include a connector 1750 operable to limit the degree of pivot between the stanchions 1710, 1720. In this manner the separable nature of the product portions 505B, 515A may be demonstrated to the user.

Thus, the reconfigurable display package 10 of the present invention assists a user (or buyer at the point of purchase) in identifying unique features of the product contained within the package (e.g., that the product includes components that are interchangeable/reconfigurable, being selectively separated and joined). In addition, the improved display package 10 in accordance with the present invention permits a user/buyer to interact with the product at the point of sale, thus providing a "try-me" feature.

While the invention has been described in detail and with reference to specific embodiments thereof, it will be apparent to one skilled in the art that various changes and modifications can be made therein without departing from the spirit and scope thereof. For example, the display package 10 may be formed from any suitable materials, including flexible materials, rigid materials, etc. By way of specific example, the display package may comprise paper, plastic, etc. The material forming the display package 10 may be opaque, transparent, translucent, etc. The display package 10 and its components may be of any shape and may possess any dimensions suitable for its described purpose.

The complete product 500 may be of any size and shape. For example, the product components may represent the longitudinal or latitudinal halves (or any other fraction) of humanoid figures, or may represent the portions of animals, vehicles, buildings, etc. The reconfigurable display package 10 may further display other product portions comprising elements (miniaturized or full-scale) relating to home décor (e.g., combinations of cabinet and countertop displays, etc.).

The product housing 400 may include any number of housing segments and may be adapted to move and/or rotate vertically, horizontally, or diagonally, or slide in any direction. The product housing 400 may contain any number of individual product portions. The product housing 400 may be divided into compartments/segments modified to secure a product portion in a predetermined position. In addition, the product housing 400 may include a single compartment/segment with product portions secured in predetermined positions therein (e.g., by posts, tie strings, etc.). Similarly, the platforms 160A, 160B may include any number of platforms and may be fixed or adapted for movement. When adapted for movement, the platforms may move vertically, horizontally, or diagonally, or slide in any direction.

It is to be understood that terms such as "top", "bottom", "front", "rear", "side", "height", "length", "width", "upper", "lower", "interior", "exterior", "inner", "outer" and the like as may be used herein, merely describe points of reference and do not limit the present invention to any particular orientation or configurations. Thus, it is intended that the present invention covers the modifications and variations of this invention provided they come within the scope of the appended claims and their equivalents.

I claim:

1. A display package for a product having plurality of complementary portions, the display package comprising:

a display package housing;

a product separable into portions removably housed within the display package housing, the product including:

a first product portion, and a second product portion complementary to the first product portion, the second product portion being configured to separably connect to the first product portion, wherein the product is configurable in a first product display position, in which the first product portion is connected to the second product portion, and in a second product display position, in which the first product portion is completely separated from the second product portion; and a display package actuator coupled to and movable along the display package housing, wherein movement of the actuator along the display package housing reorients the product from the first product display position to the second product display position while the product is housed within the display package housing, and wherein the actuator is in communication with the first product portion such that engaging the actuator moves the first product portion with respect to the second product portion.

2. The display package of claim 1, wherein the first product portion is laterally displaceable with respect to the second product portion.

3. The display package of claim 1, wherein:

the second product portion is positionally fixed within the housing; and the actuator is in communication with the first product portion such that engaging the actuator moves the first product portion within the housing from its connected position to its separated position.

4. The display package of claim 1 further comprising a movable support member supporting the first product portion, wherein the actuator is mechanically linked to the movable support member such that engaging the actuator drives the movable support member within the housing to reorient the product from the first product display position to the second product display position.

5. The display package of claim 4 further comprising a fixed support member housed within the housing, wherein the fixed support member supports the second product portion such that the second product portion remains stationary during movement of the first product portion.

6. The display package of claim 4, wherein:

the housing comprises a backing member and shell coupled to the backing member;

the movable support member comprises a platform including ribs received within and configured to slide along guide channels formed into the backing member;

the display package actuator slides along one of the backing member and the shell; and the actuator moves the platform along the guide channels to reorient the product from the first product display position to the second product display position.

7. The display package of claim 6, wherein:

the second product portion is supported by a fixed support member; and the fixed support member comprises a platform fixed to the backing member.

8. A display package for a product having plurality of complementary portions, the display package comprising:

a display package housing;

a product comprising a single toy figurine having a humanoid form, the toy figurine being separable into a first figurine portion and a second figurine portion;

a first product support member disposed within the display package housing, the first product support member supporting the first figurine portion;

a second product support member disposed within the display package housing, the second product support member supporting the second figurine, wherein the first figurine portion couples to the second figurine portion to form the toy figurine, wherein the first product support member is selectively repositionable with respect to the second product support member while the product support members are housed within the housing, and wherein the first product support member and the second product support member are each coupled to the display package housing, and wherein the first figurine portion is removable from the first product support member and the second figurine portion is removable from the second product support member.

9. The display package of claim 8, wherein the first support member is laterally displaceable with respect to the second support member such that the first support member moves linearly.

10. The display package of claim 8, wherein repositioning the first support member within the housing reorients the product from a first product display position, in which the first and second figurine portions are oriented adjacent each other, to a second product display position, in which the first and second figurine portions are oriented in spaced relation.

11. The display package of claim 8, wherein:

the first product support member comprises a movable platform movably coupled to the housing;

the second product support member comprises a fixed platform fixedly coupled to the housing; and the second product support member remains stationary as the first product support member is selectively repositioned with respect to the second product support member.

12. The display package of claim 8, wherein:

the housing comprises a transparent shell portion and a backing member portion; and at least one of the first and second product support members are connected to the backing member portion.

13. The display package of claim 12, wherein:

an elongated guide channel is formed into the backing member portion of the housing; and the first product support member comprises:

a platform that supports the first product portion, and a rib extending from the platform and into the guide channel, the rib being operable to slide along the guide channel.

14. The display package of claim 8, wherein:

the first product support member is laterally displaceable within the housing from a first support member position to a second support member position; and repositioning the product support members within the housing reorients the product from a first product display position, in which the first and second figurine portions are coupled to each other, to a second product display position, in which the first and second figurine portions are decoupled.

15. The display package of claim 8, wherein the housing includes a first compartment containing the product and a second compartment containing a playing card.

16. The display package of claim 8, wherein:

the first figurine portion comprises a first half of the toy figurine including one half of a head, one half of a torso, one arm, and one leg;

the second figurine portion comprises a second half of the toy figurine that is complementary to the first half of the toy figurine, the second figurine half including one half of a head, one half of a torso, one arm, and one leg; and the first figurine portion connects to the second figurine portion to form a complete toy figurine.

17. The display package of claim 1, wherein:

the product comprises a toy figurine having a humanoid form, the toy figurine being separable into a first figurine portion and a second figurine portion;

the first product portion is the first figurine portion;

the second product portion is the second figurine portion;

the first figurine portion comprises a first half of the toy figurine including one half of a head, one half of a torso, one arm, and one leg;

the second figurine portion comprises a second half of the toy figurine including one half of a head, one half of a torso, one arm, and one leg, the second toy figurine portion being complementary to the first toy figurine portion; and the first figurine portion connects to the second figurine portion to form the toy figurine.

18. The display package of claim 1, wherein:

the product comprises a toy figurine having a humanoid form, the toy figurine being separable into a first figurine portion and a second figurine portion;

the first product portion is the first figurine portion;

the second product portion is the second figurine portion; and the first figurine portion couples to the second figurine portion to form the toy figurine.

19. The display package of claim 8, wherein repositioning the first product support member within the housing reorients the product from a first product display position, in which the first and second figurine portions contact each other, to a second product display position, in which the first and second figurine portions are spaced from each other.

* * * * *